US007824832B2

(12) United States Patent
Kimura et al.

(10) Patent No.: US 7,824,832 B2
(45) Date of Patent: Nov. 2, 2010

(54) TONER FOR ELECTROPHOTOGRAPHY

(75) Inventors: Yoshitomo Kimura, Kinokawa (JP); Yasunori Inagaki, Wakayama (JP); Yoshihiro Ueno, Wakayama (JP); Katsutoshi Aoki, Wakayama (JP)

(73) Assignee: Kao Corporation, Tokyo (JP)

( * ) Notice: Subject to any disclaimer, the term of this patent is extended or adjusted under 35 U.S.C. 154(b) by 151 days.

(21) Appl. No.: 12/302,843

(22) PCT Filed: May 30, 2007

(86) PCT No.: PCT/JP2007/060981

§ 371 (c)(1),
(2), (4) Date: Nov. 28, 2008

(87) PCT Pub. No.: WO2007/142094

PCT Pub. Date: Dec. 13, 2007

(65) Prior Publication Data

US 2009/0117485 A1 May 7, 2009

(30) Foreign Application Priority Data

Jun. 2, 2006 (JP) ..... 2006-154087
Jun. 2, 2006 (JP) ..... 2006-155270

(51) Int. Cl.
*G03G 9/08* (2006.01)

(52) U.S. Cl. ..... 430/109.4; 430/137.18

(58) Field of Classification Search ..... 430/109.4, 430/137.18

See application file for complete search history.

(56) References Cited

U.S. PATENT DOCUMENTS

| | | | | |
|---|---|---|---|---|
| 5,660,963 | A | 8/1997 | Doujo et al. | |
| 6,326,115 | B1 | 12/2001 | Nakanishi et al. | |
| 6,361,914 | B1 | 3/2002 | Semura et al. | |
| 7,713,672 | B2 * | 5/2010 | Watanabe et al. | 430/123.5 |
| 7,718,340 | B2 * | 5/2010 | Iwamoto et al. | 430/123.5 |
| 2006/0078815 | A1 | 4/2006 | Ito et al. | |
| 2007/0248380 | A1 * | 10/2007 | Iwamoto et al. | 399/130 |
| 2009/0069530 | A1 * | 3/2009 | Kimura et al. | 528/279 |

FOREIGN PATENT DOCUMENTS

| | | |
|---|---|---|
| JP | 2-82267 | 3/1990 |
| JP | 4-70765 | 3/1992 |
| JP | 4-307557 | 10/1992 |
| JP | 5-346686 | 12/1993 |
| JP | 7-286139 | 10/1995 |
| JP | 8-20636 | 1/1996 |
| JP | 8-234487 | 9/1996 |
| JP | 10-239903 | 9/1998 |
| JP | 11-133668 | 5/1999 |
| JP | 2001-100459 | 4/2001 |
| JP | 2003-105071 | 4/2003 |
| JP | 2004-245854 | 9/2004 |
| JP | 2004-285255 | 10/2004 |
| JP | 2005-55691 | 3/2005 |
| JP | 2005-350597 | 12/2005 |

* cited by examiner

*Primary Examiner*—Hoa V Le
(74) *Attorney, Agent, or Firm*—Oblon, Spivak, McClelland, Maier & Neustadt, L.L.P.

(57) ABSTRACT

A toner for electrophotography, containing a resin binder containing a polyester-based resin (A) and a polyester-based resin (B) having a softening point of a temperature higher than the polyester-based resin (A) by 10° C. or more, wherein at least one of the polyester-based resins (A) and (B) is a resin derived from a (meth)acrylic acid-modified rosin, having a polyester unit obtainable by polycondensing an alcohol component and a carboxylic acid component containing a (meth) acrylic acid-modified rosin, and a method for producing the toner. The toner for electrophotography of the present invention is usable in, for example, developing or the like latent images formed in electrophotography, electrostatic recording method, electrostatic printing method or the like.

13 Claims, No Drawings

TONER FOR ELECTROPHOTOGRAPHY

TECHNICAL FIELD

The present invention relates to a toner for electrophotography usable in, for example, developing latent images formed in electrophotography, electrostatic recording method, electrostatic printing method or the like, and a method for producing such a toner.

BACKGROUND ART

With the development of electrophotographic techniques, a toner having excellent low-temperature fixing ability, offset resistance, and storage ability (blocking resistance) has been required. For this purpose, a toner containing a linear polyester resin of which physical properties such as a molecular weight are defined (see Patent Publication 1); a toner containing a nonlinear cross-linked polyester resin in which a rosin is used as an acid component in the polyester (see Patent Publication 2); a toner with improved fixing ability in which a rosin modified with maleic acid is used (see Patent Publication 3); further, a toner in which a resin prepared by blending a low-molecular weight resin and a high-molecular weight resin is used (see Patent Publication 4); and the like have been reported.

Patent Publication 1: JP-A-2004-245854

Patent Publication 2: JP-A-Hei-4-70765

Patent Publication 3: JP-A-Hei-4-307557

Patent Publication 4: JP-A-Hei-2-82267

SUMMARY OF INVENTION

The present invention relates to:

[1] a toner for electrophotography, containing a resin binder containing a polyester-based resin (A) and a polyester-based resin (B) having a softening point of a temperature higher than the polyester-based resin (A) by 10° C. or more, wherein at least one of the polyester-based resins (A) and (B) is a resin derived from a (meth)acrylic acid-modified rosin, having a polyester unit obtainable by polycondensing an alcohol component and a carboxylic acid component containing a (meth) acrylic acid-modified rosin; and

[2] A method for producing a toner for electrophotography, including the step of melt-kneading at least a polyester-based resin (A) and a polyester-based resin (B) having a softening point of a temperature higher than the polyester-based resin (A) by 10° C. or more, wherein at least one of the polyester-based resins (A) and (B) is a resin derived from a (meth) acrylic acid-modified rosin, having a polyester unit obtainable by polycondensing an alcohol component and a carboxylic acid component comprising a (meth)acrylic acid-modified rosin.

DETAILED DESCRIPTION OF THE INVENTION

However, with further progress in speeding up and energy conservation of the machine in the recent years, it has been found that conventional resin binders for toners do not sufficiently meet the demands of the market. In other words, it has become very difficult to maintain a sufficient fixing strength due to the shortening of a fixing time in the fixing step and lowering of a temperature of a heating temperature fed from the fixing device. Especially, in the method in which a low-molecular weight resin is used, the lowering of the glass transition temperature inevitably accompanies, so that there is a disadvantage that the toner is undesirably aggregated upon storage.

In addition, because of the lowering of durability of the toner accompanying strong stress applied upon printing, an insufficient initial rise of triboelectric charges of the toner accompanying speeding up of the machine, the generation of filming due to dispersion failure of an internal additive, and the like, the deterioration of images upon high-speed continuous printing, in particular, is disadvantageous.

Further, while the rosin monomer usable in Patent Publication 2 or Patent Publication 3 is effective in the improvement of low-temperature fixing ability, there is a disadvantage that an odor is more likely to be generated.

The present invention relates to a toner for electrophotography having excellent low-temperature fixing ability, offset resistance, durability, and storage ability and having reduced generation of an odor, and a method for producing the toner. Further, the present invention relates to a toner for electrophotography not only having excellent low-temperature fixing ability, offset resistance, durability, and storage ability, but also having excellent filming resistance and an initial rise of triboelectric charges, and a method for producing the toner.

The toner for electrophotography of the present invention exhibits excellent effects of having excellent low-temperature fixing ability, offset resistance, durability, and storage ability, and having reduced generation of an odor. In the toner for electrophotography of the present invention, in a case where a resin having a lower softening point is a resin derived from a (meth)acrylic acid-modified rosin, and a resin having a higher softening point is a resin derived from a fumaric acid/maleic acid-modified rosin, further effects in filming resistance and initial rise in triboelectric charges are exhibited in addition to the above effects.

One of the features of the toner for electrophotography of the present invention resides in that resin binders contain a polyester-based resin (A) and a polyester-based resin (B) having a softening point of a temperature higher than the polyester-based resin (A) by 10° C. or more, wherein at least one of said polyester-based resins (A) and (B) is a resin derived from a (meth)acrylic acid-modified rosin having a polyester unit obtainable by polycondensing an alcohol component and a carboxylic acid component containing a (meth) acrylic acid-modified rosin as a raw material monomer. The resin derived from the (meth)acrylic acid-modified rosin can be fixed at a very low temperature, and has excellent storage ability. In addition, the generation of fine powder in the developer vessel is reduced, thereby improving the durability. It is considered that such advantages are found because the (meth) acrylic acid-modified rosin is a rosin having two functional groups, so that the molecular chain can be extended as a part of a main chain of a polyester unit, thereby increasing the toughness of the resin.

On the other hand, the satisfaction of low-temperature fixing ability and durability, offset resistance and storage ability of a toner by a combined use of two kinds of resins having different softening points have been conventionally tried; however, resins having different softening points have different melt viscosities, both of the resins are not likely to be homogeneously mixed, thereby making it likely to lower the dispersibility of an internal additive such as a colorant and a releasing agent. By contrast, in the present invention, in a case where a polyester-based resin having a lower softening point is a resin derived from a (meth)acrylic acid-modified rosin, as mentioned above, it is considered that since the (meth)acrylic acid-modified rosin is capable of elevating the molecular weight of the resin as a part of a main chain of the polyester unit, the melt viscosity is more easily increased than the softening point, so that the filming resistance accompanying dispersion failure of the internal additive is remarkably improved. Further, in a case where a polyester-based resin having a higher softening point is a resin derived from a fumaric acid/maleic acid-modified rosin having a polyester unit obtainable by polycondensing an alcohol component and a carboxylic acid component containing a fumaric acid-modified rosin and/or a maleic acid-modified rosin, the fumaric acid-modified rosin and the maleic acid-modified rosin each having a trifunctional group serve to increase a crosslinking degree of the polyester unit, thereby improving the offset resistance, and at the same time, the acid value is more likely to be increased, and further the initial rise of triboelectric charges is improved.

Therefore, the resin derived from the (meth)acrylic acid-modified rosin is usable as at least either one of the two kinds of the polyester-based resins, namely the polyester-based resins (A) and (B); as mentioned above, in the present invention, it is preferable that at least a polyester-based resin (A) having a lower softening point is a resin derived from a (meth)acrylic acid-modified rosin, from the viewpoint of filming resistance. Further, it is more preferable that both of the resins, namely, the polyester-based resin (A) and the polyester-based resin (B) having a softening point of a temperature higher than the polyester-based resin (A) by 10° C. or more are resins derived from (meth)acrylic acid-modified rosins, from the viewpoint of durability. It is more preferable that the polyester-based resin (A) is a resin derived from a (meth)acrylic acid-modified rosin, and that the polyester-based resin (B) is a resin derived from a fumaric acid/maleic acid-modified rosin, from the viewpoint of initial rise of triboelectric charges.

Regarding the resin in the present invention, for the sake of simplicity, the resins are noted herein as a resin derived from a (meth)acrylic acid-modified rosin and a resin derived from a fumaric acid/maleic acid-modified rosin, and the word "derived" as used herein means that a (meth)acrylic acid-modified rosin or a fumaric acid-modified rosin and/or a maleic acid-modified rosin is used as at least one of the raw material monomers. In addition, the resin derived from a (meth)acrylic acid-modified rosin and the resin derived from a fumaric acid/maleic acid-modified rosin are collectively referred to herein as "a resin derived from a modified rosin."

The resin derived from a (meth)acrylic acid-modified rosin will be explained hereinbelow.

The (meth)acrylic acid-modified rosin in the present invention refers to a rosin modified with (meth)acrylic acid, and obtained by an addition reaction of (meth)acrylic acid to a rosin of which main component is abietic acid, neoabietic acid, palustric acid, pimaric acid, isopimaric acid, sandaracopimaric acid, dehydroabietic acid, levopimaric acid, or the like. Specifically, the modified rosin can be obtained through a Diels-Alder reaction between levopimaric acid, abietic acid, neoabietic acid, and palustric acid, having a conjugated double bond in the main component of the rosin, and (meth) acrylic acid while heating.

Here, the term "(meth)acryl" as used herein means acryl or methacryl. Therefore, (meth)acrylic acid means acrylic acid or methacrylic acid, and the term "(meth)acrylic acid-modified rosin" means a rosin modified with acrylic acid, or a rosin modified with methacrylic acid. The (meth)acrylic acid-modified rosin in the present invention is preferably an acrylic acid-modified rosin having modification with acrylic acid having smaller steric hindrance, from the viewpoint of the reaction activity in the Diels-Alder reaction.

The rosin has a modification degree with (meth)acrylic acid ((meth)acrylic acid-modified degree) of preferably from 5 to 105, more preferably from 20 to 105, even more preferably from 40 to 105, and even more preferably from 60 to 105, from the viewpoint of increasing a molecular weight of the polyester unit and reducing a low-molecular weight oligomer component.

The (meth)acrylic acid-modified degree is calculated by the formula (Aa):

[Su 1]

$$\text{(Meth)acrylic Acid-Modified Degree} = \frac{Xa_1 - Y}{Xa_2 - Y} \times 100 \qquad \text{(Aa)}$$

wherein $Xa_1$ is a SP value of a (meth)acrylic acid-modified rosin of which modified degree is calculated, $Xa_2$ is a saturated SP value of a (meth)acrylic acid-modified rosin obtainable by reacting one mol of (meth)acrylic acid and one mol of a rosin, and Y is a SP value of the rosin. Here, the SP value means a softening point as determined with a ring-and-ball type automatic softening point tester described later. Also, the saturated SP value means a SP value when the reaction between (meth)acrylic acid and the rosin is carried out until a saturated value of a SP value of the resulting (meth)acrylic acid-modified rosin is attained. The molecule of the formula (Aa) means an increased degree of a SP value of the rosin modified with (meth)acrylic acid, where the larger the value of the formula (Aa), the higher the degree of modification.

A method for producing a (meth)acrylic acid-modified rosin is not particularly limited. For example, a (meth)acrylic acid-modified rosin can be obtained by the steps of mixing a rosin and (meth)acrylic acid and heating to a temperature of 180° to 260° C. or so, preferably from 180° to 210° C., to carry out a Diels-Alder reaction, thereby adding (meth) acrylic acid to an acid containing a conjugated double bond contained in the rosin. The (meth)acrylic acid-modified rosin may be used as it is, or may be further purified through a procedure such as distillation and used.

Next, the resin derived from a fumaric acid/maleic acid-modified rosin will be explained. Here, "the resin derived from a fumaric acid/maleic acid-modified rosin" in the present invention includes i) a resin derived from a fumaric acid-modified rosin having a polyester unit obtained by polycondensing an alcohol component and a carboxylic acid component containing a fumaric acid-modified rosin obtained by modification with fumaric acid; ii) a resin derived from a maleic acid-modified rosin having a polyester unit obtained by polycondensing an alcohol component and a carboxylic acid component containing a maleic acid-modified rosin obtained by modification with maleic acid; and iii) a resin derived from a fumaric acid- and maleic acid-modified rosin having a polyester unit obtained by polycondensing an alcohol component and a carboxylic acid component containing a fumaric acid-modified rosin and a maleic acid-modified rosin. In the present invention, the resin derived from a fumaric acid-modified rosin is preferred, from the viewpoint of storage ability.

The fumaric acid-modified rosin in the present invention refers to a rosin modified with fumaric acid, and obtained by an addition reaction of fumaric acid to a rosin of which main component is abietic acid, neoabietic acid, palustric acid, pimaric acid, isopimaric acid, sandaracopimaric acid, dehydroabietic acid, levopimaric acid, or the like, in the same manner as in the (meth)acrylic acid-modified rosin. Specifically, the modified rosin can be obtained through a Diels-Alder reaction between levopimaric acid, abietic acid, neoabietic acid, and palustric acid, having a conjugated double bond in the main component of the rosin, and fumaric acid while heating.

The rosin has a modification degree with fumaric acid (fumaric acid-modified degree) of preferably from 5 to 105, more preferably from 20 to 105, even more preferably from 40 to 105, and even more preferably from 60 to 105, from the viewpoint of increasing a molecular weight of the polyester and increasing a glass transition temperature.

The fumaric acid-modified degree is calculated by the formula (Af):

[Su 2]

$$\text{Fumaric Acid-Modified Degree} = \frac{Xf_1 - Y}{Xf_2 - Y} \times 100 \quad \text{(Af)}$$

wherein $Xf_1$ is a SP value of a fumaric acid-modified rosin of which modified degree is calculated, $Xf_2$ is a SP value of a fumaric acid-modified rosin obtainable by reacting one mol of fumaric acid and 0.7 mol of a rosin, and Y is a SP value of the rosin.

Here, the SP value means a softening point as determined with a ring-and-ball type automatic softening point tester described later. In the same manner as in the (meth)acrylic acid-modified degree calculated by the formula (Aa), the molecule of the formula (Af) means an increased degree of a SP value of the rosin modified with fumaric acid, where the larger the value of the formula (Af), the higher the degree of modification.

A method for producing a fumaric acid-modified rosin is not particularly limited. For example, a fumaric acid-modified rosin can be obtained by the steps of mixing a rosin and fumaric acid and heating to a temperature of 180° to 260° C. or so, and preferably from 180° to 210° C., to carry out a Diels-Alder reaction, thereby adding fumaric acid to an acid containing a conjugated double bond contained in the rosin.

Further, it is preferable that the rosin and the fumaric acid are allowed to react in the presence of a phenol, from the viewpoint of efficiently reacting the rosin and the fumaric acid. The phenol is preferably a dihydric phenol and a phenolic compound having at least a substituent at an ortho-position to the hydroxyl group (hereinafter referred to as a hindered phenol), and the hindered phenol is more preferred.

The dihydric phenol means a compound in which two OH groups are bonded to a benzene ring, but other substituents are not bonded thereto, and hydroquinone is preferred.

The hindered phenol includes mono-t-butyl-p-cresol, mono-t-butyl-m-cresol, t-butyl catechol, 2,5-di-t-butyl hydroquinone, 2,5-di-t-amyl hydroquinone, propyl gallate, 4,4'-methylenebis(2,6-t-butylphenol), 4,4'-isopropylidenebis(2,6-di-t-butylphenol), 4,4'-butylidenebis(3-methyl-6-t-butylphenol), butylhydroxyanisole, 2,6-di-t-butyl-p-cresol, 2,6-di-t-butylphenol, 2,6-di-t-butyl-4-ethylphenol, 2,4,6-tri-t-butylphenol, octadecyl-3-(4-hydroxy-3',5'-di-t-butylphenyl)propionate, distearyl(4-hydroxy-3-methyl-5-t-butyl) benzyl malonate, 6-(4-hydroxy-3,5-di-t-butylanilino)-2,4-bisoctylthio-1,3,5-triazine, 2,6-diphenyl-4-octadecanoxyphenol, 2,2'-methylenebis(4-methyl-6-t-butylphenol), 2,2'-methylenebis(4-ethyl-6-t-butylphenol), 2,2'-isobutylidenebis(4,6-dimethylphenol), 2,2'-dihydroxy-3,3'-di-(α-methylcyclohexyl)-5,5'-dimethyldiphenylmethane, 2,2'-methylenebis(4-methyl-6-cyclohexylphenol), tris[β-(3,5-di-t-butyl-4-hydroxyphenyl)propionyloxyethyl] isocyanurate, 1,3,5-tris(2,6-dimethyl-3-hydroxy-4-t-butylbenzyl)isocyanurate, tris(3,5-di-t-butyl-4-hydroxyphenol) isocyanurate, 1,1,3'-tris(2-methyl-4-hydroxy-5-t-butylphenyl)butane, 2,6-bis(2'-hydroxy-3'-t-butyl-5'-methylbenzyl)-4-methylphenol, N,N'-hexamethylenebis(3,5-di-t-butyl-4-hydroxyhydrocinnamate), hexamethyleneglycolbis[β-(3,5-di-t-butyl-4-hydroxyphenyl)propionate], triethyleneglycolbis[β-(3-t-butyl-5-methyl-4-hydroxyphenyl)propionate], tetrakis[methylene-3-(3,5-di-t-butyl-4-hydroxyphenyl)propionate]methane, and the like. Among them, t-butyl catechol is preferred.

The amount of the phenol used is preferably from 0.001 to 0.5 parts by weight, more preferably from 0.003 to 0.1 parts by weight, and even more preferably from 0.005 to 0.1 parts by weight, based on 100 parts by weight of the raw material monomers for the fumaric acid-modified rosin.

The fumaric acid-modified rosin may be used as it is, or may be further purified through a procedure such as distillation and used.

The maleic acid-modified rosin in the present invention refers to a rosin modified with maleic acid or maleic anhydride, and obtained by an addition reaction of maleic acid or maleic anhydride to a rosin of which main component is abietic acid, neoabietic acid, palustric acid, pimaric acid, isopimaric acid, sandaracopimaric acid, dehydroabietic acid, levopimaric acid, or the like, in the same manner as the (meth)acrylic acid-modified rosin. Specifically, the modified rosin can be obtained through a Diels-Alder reaction between levopimaric acid, abietic acid, neoabietic acid, and palustric acid, having a conjugated double bond in the main component of the rosin, and maleic acid or maleic anhydride while heating.

The rosin has a modification degree with maleic acid or maleic anhydride (maleic acid-modified degree) of preferably from 30 to 105, more preferably from 40 to 105, even more preferably from 50 to 105, even more preferably from 60 to 105, and even more preferably from 70 to 105, from the viewpoint of increasing a molecular weight of the polyester and reducing a low-molecular weight oligomer component.

The maleic acid-modified degree is calculated by the formula (Am):

[Su 3]

$$\text{Maleic Acid-Modified Degree} = \frac{Xm_1 - Y}{Xm_2 - Y} \times 100 \quad \text{(Am)}$$

wherein $Xm_1$ is a SP value of a maleic acid-modified rosin of which modified degree is calculated, $Xm_2$ is a saturated SP value of a maleic acid-modified rosin obtainable by reacting one mol of maleic acid and one mol of a rosin at 230° C., and Y is a SP value of the rosin.

Here, the SP value means a softening point as determined with a ring-and-ball type automatic softening point tester described later. Also, the saturated SP value means a SP value when the reaction between maleic acid and the rosin is carried out until a saturated value of a SP value of the resulting maleic acid-modified rosin is attained. The molecule of the formula (Am) means an increased degree of a SP value of the rosin modified with maleic acid or maleic anhydride, in the same manner as in the (meth)acrylic acid-modified degree calculated by the formula (Aa), where the larger the value of the formula (Am), the higher the degree of modification.

A method for producing a maleic acid-modified rosin is not particularly limited. For example, a maleic acid-modified rosin can be obtained by the steps of mixing a rosin and maleic acid or maleic anhydride and heating to a temperature of 180° to 260° C. or so, and preferably from 180° to 210° C., to carry out a Diels-Alder reaction, thereby adding maleic acid or maleic anhydride to an acid containing a conjugated double bond contained in the rosin. The maleic acid-modified rosin may be used as it is, or may be further purified through a procedure such as distillation and used.

The rosin used in the (meth)acrylic acid-modified rosin, the fumaric acid-modified rosin, and the maleic acid-modified rosin (these are collectively referred to as "modified rosin") in the present invention include natural rosins obtained from pine trees, isomerized rosins, dimerized rosins, polymerized rosins, disproportionate rosins and the like, and a known rosin can be used, so long as the rosin may be a rosin of which main components are abietic acid, neoabietic acid, palustric acid, pimaric acid, isopimaric acid, sandaracopimaric acid, dehydroabietic acid, levopimaric acid, and the like. From the viewpoint of color, natural rosins, such as a tall rosin obtained from a tall oil obtainable as a by-product in the process of manufacturing a natural rosin pulp, gum rosin obtainable from a crude turpentine, and a wood rosin obtained from stumps of pine tree are preferred. The tall rosin is more preferred, from the viewpoint of low-temperature fixing ability.

The modified rosin in the present invention is obtained through a Diels-Alder reaction while heating, so that impurities which are causations for an odor are reduced making it less odorous. From the viewpoint of further reducing an odor and improving storage ability, the (meth)acrylic acid-modified rosin is preferably obtained by modification with (meth) acrylic acid of a rosin having reduced impurities through a purification step (purified rosin), and more preferably obtained by modification of a purified tall rosin with (meth) acrylic acid. Similarly, the fumaric acid-modified rosin is preferably obtained by modification with fumaric acid of a rosin having reduced impurities through a purification step (purified rosin), and more preferably obtained by modification of a purified tall rosin with fumaric acid. In addition, the maleic acid-modified rosin is preferably obtained by modification with maleic acid or maleic anhydride of a rosin having reduced impurities through a purification step (purified rosin), and more preferably obtained by modification of a purified tall rosin with maleic acid or maleic anhydride.

The purified rosin in the present invention is a rosin from which impurities are reduced by a purification step. The impurities contained in the rosin can be removed by purifying the rosin. The main impurities include 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, 4-(1-methylethyl)benzaldehyde, and the like. In the present invention, peak intensities of three kinds of impurities of those listed above, hexanoic acid, pentanoic acid, and benzaldehyde, which are detected as volatile components according to headspace GC-MS method, can be used as an index for a purified rosin. Here, the reason why that the specified volatile components are used as indexes, not in absolute amounts of impurities, is in that the use of the purified rosin in the present invention has an objective of improvement in odor against conventional polyesters using rosins.

Specifically, the purified rosin in the present invention refers to a rosin in which a peak intensity of hexanoic acid is $0.8\times10^7$ or less, a peak intensity of pentanoic acid is $0.4\times10^7$ or less, and a peak intensity of benzaldehyde is $0.4\times10^7$ or less, under measurement conditions for headspace GC-MS method described later. Further, from the viewpoint of storage ability and odor, the peak intensity of hexanoic acid is preferably $0.6\times10^7$ or less, and more preferably $0.5\times10^7$ or less. The peak intensity of pentanoic acid is preferably $0.3\times10^7$ or less, and more preferably $0.2\times10^7$ or less. The peak intensity of benzaldehyde is preferably $0.3\times10^7$ or less, and more preferably $0.2\times10^7$ or less.

Further, it is preferable that n-hexanal and 2-pentylfuran are reduced in addition to the three kinds of substances mentioned above, from the viewpoint of storage ability and odor. The peak intensity of n-hexanal is preferably $1.7\times10^7$ or less, more preferably $1.6\times10^7$ or less, and even more preferably $1.5\times10^7$ or less. In addition, the peak intensity of 2-pentylfuran is preferably $1.0\times10^7$ or less, more preferably $0.9\times10^7$ or less, and even more preferably $0.8\times10^7$ or less.

As a method of purifying a rosin, a known method can be utilized, and the method includes a method by distillation, recrystallization, extraction or the like, and it is preferable that the rosin is purified by distillation. As a method of distillation, a method described, for example, in JP-A-Hei-7-286139 can be utilized. The method of distillation includes vacuum distillation, molecular distillation, steam distillation, and the like, and it is preferable that the rosin is purified by vacuum distillation. For example, distillation is carried out usually at a pressure of 6.67 kPa or less and at a stilling temperature of from 200° to 300° C., an ordinary simple distillation as well as a method of thin-film distillation, rectification, or the like can be applied. The high-molecular weight compound is removed as a pitch component in an amount of from 2 to 10% by weight, and at the same time an initial distillate is removed in an amount of from 2 to 10% by weight, each based on the charged rosin under ordinary distillation conditions.

The rosin before the modification has a softening point of preferably from 50° to 100° C., more preferably from 60° to 90° C., and even more preferably from 65° to 85° C. The softening point of the rosin in the present invention means a softening point determined when a rosin is once melted, and air-cooled for 1 hour under environmental conditions of a temperature of 25° C. and a relative humidity of 50%, in accordance with a method described later.

Further, the rosin before the modification has an acid value of preferably from 100 to 200 mg KOH/g, more preferably from 130 to 180 mg KOH/g, and even more preferably from 150 to 170 mg KOH/g.

Here, the fumaric acid-modified rosin has a glass transition temperature of preferably from 40° to 90° C., more preferably from 45° to 85° C., and even more preferably from 50° to 80° C., from the viewpoint of increasing the storage ability of the resulting polyester. In addition, in the fumaric acid-modified rosin, the rosin before the modification has a glass transition temperature of preferably from 10° to 50° C., and more preferably from 15° to 50° C., taking into consideration of the glass transition temperature of the rosin after the modification with fumaric acid.

In addition, the maleic anhydride-modified rosin has a glass transition temperature of preferably from 35° to 90° C., and more preferably from 45° to 70° C., from the viewpoint of increasing the storage ability of the resulting polyester. In addition, in the maleic anhydride-modified rosin, the rosin before the modification has a glass transition temperature of preferably from 10° to 50° C., and more preferably from 15° to 50° C., taking into consideration of the glass transition temperature of the rosin after the modification with maleic anhydride.

Also, the amount of the (meth)acrylic acid-modified rosin contained, and a total amount of fumaric acid-modified rosin and the maleic acid-modified rosin contained, are preferably 5% by weight or more, and more preferably 10% by weight or more, of the carboxylic acid component of the resin derived from each modified rosin, from the viewpoint of low-temperature fixing ability. In addition, the amount and the total amount are preferably 85% by weight or less, more preferably 65% by weight or less, and even more preferably 50% by weight or less, from the viewpoint of storage ability. From these viewpoints, the amount of the (meth)acrylic acid-modified rosin contained, and a total amount of fumaric acid-modified rosin and the maleic acid-modified rosin contained is preferably from 5 to 85% by weight, more preferably from 5 to 65% by weight, and even more preferably from 10 to 50% by weight, of the carboxylic acid component of the resin derived from each modified rosin.

The carboxylic acid compound other than the modified rosin, contained in the carboxylic acid component, includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; aromatic dicarboxylic acids such as phthalic acid, isophthalic acid, and terephthalic acid; alicyclic dicarboxylic acids such as cyclohexanedicarboxylic acid; tricarboxylic or higher polycarboxylic acids such as trimellitic acid and pyromellitic acid; acid anhydrides thereof, alkyl (1 to 3 carbon atoms) esters thereof, and the like. The carboxylic acid, and the anhydride and the alkyl ester of the carboxylic acid as exemplified above are collectively referred to herein as a carboxylic acid compound.

It is preferable that the alcohol component contains an aliphatic alcohol, especially an aliphatic polyhydric alcohol, from the viewpoint of offset resistance. The aliphatic polyhydric alcohol is preferably a dihydric to hexahydric aliphatic polyhydric alcohol, and more preferably a dihydric to trihydric aliphatic polyhydric alcohol, from the viewpoint of its reactivity with a carboxylic acid component containing a modified rosin. In addition, it is preferable that the aliphatic polyhydric alcohol contains an aliphatic polyhydric alcohol having 2 to 6 carbon atoms of which molecular structure is more compact and rich in reactivity. The aliphatic polyhydric alcohol having 2 to 6 carbon atoms includes ethylene glycol, neopentyl glycol, 1,2-propanediol, 1,3-propanediol, 1,4-butanediol, 1,6-hexanediol, 2,3-butanediol, pentaerythritol, trimethylolpropane, sorbitol, glycerol, and the like. Among them, 1,2-propanediol, 1,3-propanediol, and glycerol are preferred. The aliphatic polyhydric alcohol having 2 to 6 carbon atoms is contained in an amount of preferably 60% by mol or more, more preferably 80% by mol or more, even more preferably 90% by mol or more, and even more preferably substantially 100% by mol, of the aliphatic polyhydric alcohol.

The alcohol other than the aliphatic polyhydric alcohol, contained in the alcohol component, includes an alkylene oxide adduct of bisphenol A, such as alkylene (2 to 3 carbon atoms) oxide adducts (average number of moles added: 1 to 16) of bisphenol A, such as polyoxypropylene-2,2-bis(4-hydroxyphenyl)propane, and polyoxyethylene-2,2-bis(4-hydroxyphenyl)propane, 1,4-cyclohexanedimethanol, hydrogenated bisphenol A, and alkylene (2 to 4 carbon atoms) oxide adducts (average number of moles added: 1 to 16) thereof, and the like.

The aliphatic polyhydric alcohol is contained in an amount of preferably 50% by mol or more, more preferably 60% by mol or more, even more preferably 85% by mol or more, and even more preferably substantially 100% by mol, of the alcohol component, from the viewpoint of reactivity with the modified rosin.

It is preferable that the alcohol component contains a trihydric or higher polyhydric alcohol and/or the carboxylic acid component contains a tricarboxylic or higher polycarboxylic acid compound (in a case where the carboxylic acid component is a resin derived from a fumaric acid/maleic acid-modified rosin, a tricarboxylic or higher polycarboxylic acid compound other than the fumaric acid-modified rosin and the maleic acid-modified rosin), within the range so as not to impair the storage ability, from the viewpoint of improving offset resistance. Particularly, the (meth)acrylic acid-modified rosin usable in the present invention is a rosin having two functional groups, a trivalent or higher polyvalent raw material monomer can be used without impairing low-temperature fixing ability of the rosin, and whereby offset resistance can be further improved at the same time maintaining low-temperature fixing ability. The tricarboxylic or higher polycarboxylic acid compound is contained in an amount of preferably from 0.001 to 40 mol, and more preferably from 0.1 to 25 mol, based on 100 mol of the alcohol component, and the trihydric or higher polyhydric alcohol is contained in an amount of preferably from 0.001 to 40% by mol, and more preferably from 0.1 to 25% by mol, of the alcohol component, from these viewpoints.

In the trivalent or higher polyvalent raw material monomers, the tricarboxylic or higher polycarboxylic acid compound is preferably trimellitic acid and a derivative thereof, and the trihydric or higher polyhydric alcohol includes glycerol, pentaerythritol, trimethylolpropane, sorbitol, alkylene (2 to 4 carbon atoms) oxide (average number of moles added: 1 to 16) adducts thereof, and the like. Among them, glycerol, trimellitic acid and a derivative thereof are preferred because these compounds are not only effective in acting as a branching site or as a cross-linking agent, but also improving low-temperature fixing ability.

It is preferable that the polycondensation of an alcohol component with a carboxylic acid component is carried out in the presence of an esterification catalyst. Examples of the esterification catalysts in the present invention include Lewis acids such as p-toluenesulfonic acid, titanium compounds, tin(II) compounds without containing a Sn—C bond, and the like. These esterification catalysts can be used alone or in admixture of both kinds. In the present invention, titanium compounds and/or tin(II) compounds without containing a Sn—C bond are preferred.

The titanium compound is preferably a titanium compound having a Ti—O bond, and a compound having an alkoxy group, an alkenyloxy group, or an acyloxy group, having a total number of carbon atoms of from 1 of 28, is more preferable.

Specific examples of the titanium compound include titanium diisopropylate bis(triethanolaminate) [$Ti(C_6H_{14}O_3N)_2(C_3H_7O)_2$], titanium diisopropylate bis(diethanolaminate) [$Ti(C_4H_{10}O_2N)_2(C_3H_7O)_2$], titanium dipentylate bis(triethanolaminate) [$Ti(C_6H_{14}O_3N)_2(C_5H_{110})_2$], titanium diethylate bis(triethanolaminate) [$Ti(C_6H_{14}O_3N)_2(C_2H_5O)_2$], titanium dihydroxyoctylate bis(triethanolaminate) [$Ti(C_6H_{14}O_3N)_2(OHC_8H_{16}O)_2$], titanium distearate bis(triethanolaminate) [$Ti(C_6H_{14}O_3N)_2(C_{18}H_{37}O)_2$], titanium triisopropylate triethanolaminate [$Ti(C_6H_{14}O_3N)_1(C_3H_7O)_3$], titanium monopropylate tris(triethanolaminate) [$Ti(C_6H_{14}O_3N)_3(C_3H_7O)_1$], and the like. Among them, titanium diisopropylate bis(triethanolaminate), titanium diisopropylate bis(diethanolaminate) and titanium dipentylate bis(triethanolaminate) are preferable, which are available, for example, as marketed products of Matsumoto Trading Co., Ltd. Other specific examples of the preferred titanium compound include tetra-n-butyl titanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyl dihydroxyoctyl titanate [$Ti(C_8H_{17}O)_2(OHC_8H_{16}O)_2$], dimyristyl dioctyl titanate [$Ti(C_{14}H_{29}O)_2(C_8H_{17}O)_2$], and the like. Among them, tetrastearyl titanate, tetramyristyl titanate, tetraoctyl titanate and dioctyl dihydroxyoctyl titanate are preferable. These titanium compounds can be obtained by, for example, reacting a titanium halide with a corresponding alcohol, or are also available as marketed products of Nisso, or the like.

The titanium compound is present in an amount of preferably from 0.01 to 1.0 part by weight, and more preferably from 0.1 to 0.7 parts by weight, based on 100 parts by weight of a total amount of the alcohol component and the carboxylic acid component.

The tin(II) compound without containing a Sn—C bond is preferably a tin(II) compound having a Sn—O bond, a tin(II) compound having a Sn—X bond, wherein X is a halogen atom, or the like, and the tin(II) compound having a Sn—O bond is more preferable.

The tin (II) compound containing a Sn—O bond includes tin(II) carboxylate having a carboxylate group having 2 to 28 carbon atoms, such as tin(II) oxalate, tin(II) diacetate, tin(II) dioctanoate, tin(II) dilaurate, tin(II) distearate, and tin(II) dioleate; dialkoxy tin(II) having an alkoxy group having 2 to 28 carbon atoms, such as dioctyloxy tin(II), dilauroxy tin(II), distearoxy tin(II), and dioleyloxy tin(II); tin(II) oxide; tin(II) sulfate; and the like, and the tin(II) compound containing a Sn—X bond, wherein X is a halogen atom, includes tin(II) halides, such as tin(II) chloride and tin(II) bromide, and the like. Among them, a fatty acid tin(II) represented by the formula $(R^1COO)_2Sn$, wherein $R^1$ is an alkyl group or alkenyl group having 5 to 19 carbon atoms, a dialkoxy tin(II) represented by the formula $(R^2O)_2Sn$, wherein $R^2$ is an alkyl group or alkenyl group having 6 to 20 carbon atoms, and tin(II) oxide represented by SnO are preferable, and the fatty acid tin(II) represented by the formula $(R^1COO)_2Sn$ and tin(II) oxide are more preferable, and tin(II) dioctanoate, tin(II) distearate, and tin(II) oxide are even more preferable, from the viewpoint of an effect of initial rise of triboelectric charges and catalytic ability.

The tin(II) compound is present in an amount of preferably from 0.01 to 1.0 part by weight, and more preferably from 0.1 to 0.7 parts by weight, based on 100 parts by weight of the total amount of the alcohol component and the carboxylic acid component.

When the titanium compound and the tin(II) compound are used together, the titanium compound and the tin(II) compound are present in a total amount of preferably from 0.01 to 1.0 part by weight, and more preferably from 0.1 to 0.7 parts by weight, based on 100 parts by weight of the total amount of the alcohol component and the carboxylic acid component.

The polycondensation of the alcohol component and the carboxylic acid component can be carried out, for example, at a temperature of from 180° to 250° C. in an inert gas atmosphere in the presence of the above-mentioned esterification catalyst.

The difference in the softening points of the two kinds of the polyester-based resins is 10° C. or more, from the viewpoint of increasing dispersibility of an internal additive, thereby enhancing the effects for fixing ability and offset resistance, especially high-temperature offset resistance. In an achromatic toner, such as a black toner, the difference in the softening points is preferably from 10° to 60° C., and more preferably from 20° to 50° C., from the viewpoint of controlling gloss. In addition, in a chromatic toner such as a yellow toner, a magenta toner or a cyan toner, the difference in the softening points is preferably from 10° to 30° C., and more preferably from 10° to 30° C., and more preferably from 15° to 30° C., from the viewpoint of increasing gloss. The polyester-based resin (A) having a lower softening point has a softening point of preferably from 80° to 120° C., and more preferably from 90° to 110° C., from the viewpoint of fixing ability. On the other hand, the polyester-based resin (B) having a higher softening point has a softening point of preferably from 100° to 180° C., more preferably from 120° to 180° C., and even more preferably from 120° to 160° C., from the viewpoint of high-temperature offset resistance.

The polyester-based resin (A) and the polyester-based resin (B) have a glass transition temperature of preferably from 45° to 75° C., and more preferably from 50° to 70° C., from the viewpoint of fixing ability, storage ability, and durability. The polyester-based resin (A) and the polyester-based resin (B) have an acid value of preferably from 1 to 80 mg KOH/g, more preferably from 5 to 60 mg KOH/g, and even more preferably from 5 to 50 mg KOH/g, and a hydroxyl value of preferably from 1 to 80 mg KOH/g, more preferably from 8 to 50 mg KOH/g, and even more preferably from 8 to 40 mg KOH/g, from the viewpoint of triboelectric chargeability and environmental stability.

In the polyester-based resin (A) and the polyester-based resin (B), the low-molecular weight component having a molecular weight of 500 or less ascribed to the residual monomer component and the oligomer component or the like is contained in an amount of preferably 12% or less, more preferably 10% or less, even more preferably 9% or less, and even more preferably 8% or less, of the polyester-based resin, from the viewpoint of low-temperature fixing ability, offset resistance, and storage ability. The amount of the low-molecular weight component contained can be reduced by a method of increasing the modified degree, or the like. Here, the amount of the low-molecular weight component contained is determined by an areal proportion of molecular weights as determined by gel permeation chromatography (GPC) as described later.

In the present invention, it is preferable that the polyester units in the polyester-based resins (A) and (B) are amorphous polyesters different from crystalline polyesters. The term "amorphous resin" as used herein refers to a resin having a difference between a softening point and a glass transition temperature (Tg) of 30° C. or more.

The polyester-based resin (A) and the polyester-based resin (B) are in a weight ratio of preferably from 10/90 to 90/10, more preferably from 20/80 to 80/20, and even more preferably from 30/70 to 70/30, from the viewpoint of fixing ability and durability.

Here, in the present invention, in a case where the resin binder contains three or more kinds of polyester-based resins, it is sufficient that any given two kinds of resins of which total amount contained in the resin binder is 50% by weight or more may satisfy the relationship in the softening points of the polyester-based resin (A) and the polyester-based resin (B). Therefore, the resin binder may be used together with a known resin binder, including a polyester-based resin not falling under the polyester-based resin (A) and the polyester-based resin (B), for example, other resin such as a vinyl resin such as a styrene-acrylic resin, an epoxy resin, a polycarbonate, or a polyurethane, within a range so as not to impair the effects of the present invention. The polyester-based resin (A) and the polyester-based resin (B) are contained in a total amount of preferably 70% by weight or more, more preferably 80% by weight or more, even more preferably 90% by weight or more, and even more preferably essentially 100% by weight, of the resin binder.

Further, in a case where both of the polyester resin (A) and the polyester resin (B) are resins derived from (meth)acrylic acid-modified rosins, the resin derived from the (meth)acrylic acid-modified rosin is contained in an amount of preferably 70% by weight or more, more preferably 80% by weight or more, even more preferably 90% by weight or more, and even more preferably substantially 100% by weight, of the resin binder. Alternatively, in a case where the polyester-based resin (A) is a resin derived from a (meth)acrylic acid-modified rosin and the polyester-based resin (B) is a resin derived from a fumaric acid/maleic acid-modified rosin, the resin derived from a (meth)acrylic acid-modified rosin and the resin derived from a fumaric acid/maleic acid-modified rosin are contained in a total amount of preferably 70% by weight or more, more preferably 80% by weight or more, even more preferably 90% by weight or more, and even more preferably substantially 100% by weight, of the resin binder.

Here, in the present invention, the polyester-based resin refers to a resin having a polyester unit. The term "polyester unit" refers to a site having a polyester structure, and the polyester-based resin may contain not only the polyester but also a modified polyester to an extent that would not substantially impair its property. In the present invention, it is preferable that both of the polyester-based resins (A) and (B) are polyesters. The modified polyester includes a polyester which is grafted or blocked with phenol, urethane, epoxy or the like according to methods described in, for example, JP-A-Hei-11-133668, JP-A-Hei-10-239903, JP-A-Hei-8-20636, and the like; and a composite resin having two or more kinds of resin units including a polyester unit.

As the composite resin, a resin having a polyester unit and an addition polymerization resin unit, such as vinyl resin, is preferred.

The raw material monomers for the polyester unit include the alcohol component and the carboxylic acid component, in the same manner as those in the above-mentioned raw material monomers for a polyester.

On the other hand, the raw material monomer for the vinyl resin unit includes styrenic compounds such as styrene and α-methylstyrene; ethylenically unsaturated monoolefins such as ethylene and propylene; diolefins such as butadiene; vinyl halides such as vinyl chloride; vinyl esters such as vinyl acetate and vinyl propionate; esters of ethylenic monocarboxylic acids such as alkyl(1 to 18 carbon atoms) esters of (meth)acrylic acid and dimethylaminoethyl(meth)acrylate; vinyl ethers such as vinyl methyl ether; vinylidene halides such as vinylidene chloride; N-vinyl compounds such as N-vinylpyrrolidone; and the like. Among them, styrene, 2-ethylhexyl acrylate, butyl acrylate, and a long-chained alkyl(12 to 18 carbon atoms) ester of acrylic acid are preferred; styrene is preferred, from viewpoint of triboelectric chargeability; and the alkyl ester of (meth)acrylic acid is preferred, from the viewpoint of controlling fixing ability and glass transition temperature. Styrene is contained in an amount of preferably from 50 to 90% by weight, and more preferably from 75 to 85% by weight, of the raw material monomers for the vinyl resin. The monomers of styrene to the alkyl ester of (meth)acrylic acid are in a weight ratio (styrene/alkyl ester of (meth)acrylic acid) of preferably from 50/50 to 95/5, and more preferably from 70/30 to 95/5.

In the addition polymerization of the raw material monomers for a vinyl resin unit, a polymerization initiator, a crosslinking agent, or the like may be used, if necessary.

In the present invention, the raw material monomers for a polyester unit and the raw material monomers for an addition polymerization resin unit are in a weight ratio (raw material monomers for a polyester unit/raw material monomers for an addition polymerization resin unit) of preferably from 50/50 to 95/5, and more preferably from 60/40 to 95/5, because it is preferable that the continuous phase is composed of a polyester unit, and that the dispersion phase is composed of an addition polymerization resin unit.

In the present invention, it is preferable that the composite resin is a resin (hybrid resin) obtainable by using a compound capable of reacting with both of the raw material monomers for the polyester unit and the raw material monomers for the addition polymerization resin unit (dually reactive monomer), in addition to the raw materials monomers for a polyester unit and the raw material monomers for an addition polymerization resin unit.

It is preferable that the dually reactive monomer is a compound having in its molecule an ethylenically unsaturated bond and at least one functional group selected from the group consisting of a hydroxyl group, a carboxyl group, an epoxy group, a primary amino group and a secondary amino group. By using the dually reactive monomer, dispersibility of the resin forming a dispersion phase can be even more improved. Concrete examples of the dually reactive monomer include, for example, acrylic acid, fumaric acid, methacrylic acid, citraconic acid, maleic acid, 2-hydroxyethyl(meth)acrylate, glycidyl(meth)acrylate, and derivatives such as acid anhydrides of these carboxylic acids, and alkyl(1 to 2 carbon atoms) esters. Among them, acrylic acid, methacrylic acid, fumaric acid, maleic acid and derivatives of these carboxylic acids are preferred, from the viewpoint of reactivity.

In the present invention, among the dually reactive monomers, monomers having two or more functional groups (such as polycarboxylic acids), and derivatives thereof, are considered to be a raw material monomer for the polyester unit, while monomers having one functional group (such as monocarboxylic acid), and derivatives thereof, are considered to be a raw material monomer for the addition polymerization resin unit. The amount of the dually reactive monomer used, based on 100 mol of the raw material monomers for a polyester unit excluding the dually reactive monomer, is preferably from 1 to 30 mol; in a method of reacting the components at a high temperature after the addition polymerization reaction in the production process of a resin binder, the amount of the dually reactive monomer used is more preferably from 1.5 to 20 mol, and even more preferably from 2 to 10 mol, from the viewpoint of even more increasing dispersibility of the addition polymerization resin unit. In a method in which a dually reactive monomer is used in a relatively large amount while maintaining a reaction temperature to a given level after the addition polymerization reaction, the amount of the dually reactive monomer is more preferably from 4 to 15 mol, and even more preferably from 4 to 10 mol.

In the present invention, the composite resin is preferably a resin obtainable by previously mixing raw material monomers for a polyester unit and raw material monomers for an addition polymerization resin unit, and concurrently carrying out a polycondensation reaction and an addition polymerization reaction in the same reaction vessel, from the viewpoint of homogeneity of the polyester unit and the addition polymerization resin unit. In a case where a composite resin is a hybrid resin obtainable by further using a dually reactive monomer, it is preferable that the resin is a resin obtainable by previously mixing a mixture of raw material monomers for a polycondensation resin unit and raw material monomers for an addition polymerization resin unit, with a dually reactive monomer, and concurrently carrying out a polycondensation reaction and an addition polymerization reaction in the same reaction vessel.

In the present invention, the progress and the termination of the polycondensation reaction and the addition polymerization reaction are not necessarily concurrent with respect to time, and the reaction temperature and time may be appropriately selected depending upon each of the reaction mechanisms for progressing and terminating the reaction. For example, a method includes a method including the steps of mixing raw material monomers for a polyester unit, raw material monomers for an addition polymerization resin unit, a dually reactive monomer, and the like, firstly mainly performing an addition polymerization reaction under temperature conditions suitable for the addition polymerization reaction, for example, at a temperature of from 50° to 180° C., thereby forming an addition polymerization resin having a functional group capable of performing a polycondensation reaction, and subsequently heating the reaction mixture to temperature conditions suitable for the polycondensation reaction, for example, a temperature of 190° to 270° C., and mainly performing a polycondensation reaction, thereby forming a polycondensation resin.

The toner of the present invention may further properly contain an additive such as a colorant, a releasing agent, a charge control agent, a magnetic powder, a fluidity improver, an electric conductivity modifier, an extender, a reinforcing filler such as a fibrous substance, an antioxidant, an anti-aging agent, or a cleanability improver.

As the colorant, all of the dyes, pigments and the like which are used as colorants for toners can be used, including carbon blacks; acetoacetate arylamide monoazo yellow pigments, such as C. I. Pigment Yellow (which may be hereinafter simply referred to as P. Y.) 1, P. Y. 3, P. Y. 74, P. Y. 97, and P. Y. 98; acetoacetate arylamide disazo yellow pigments, such as C. I. Pigment Yellow 12, P. Y. 13, P. Y. 14, and P. Y. 17; polyazo yellow pigments, such as C. I. Pigment Yellow 93 and P. Y. 95; C. I. Pigment Yellow 180; C. I. Pigment Yellow 185; yellow dyes, such as C. I. Solvent Yellow (which may be hereinafter simply referred to as S. Y.) 19, S. Y. 77, S. Y. 79, and C. I. Disperse Yellow 164; red or crimson pigments, such as C. I. Pigment Red (which may be hereinafter simply referred to as P. R.) 48, P. R. 49:1, P. R. 53:1, P. R. 57, P. R. 57:1, P. R. 81, P. R. 122, P. R. 184, and P. R. 5; red dyes, such as C. I. Solvent Red (which may be hereinafter simply referred to as S. R.) 49, S. R. 52, S. R. 58, and S. R. 8; blue dyes such as copper phthalocyanine and derivatives thereof, such as C. I. Pigment Blue 15:3; green pigments, such as C. I. Pigment Green (which may be hereinafter simply referred to as P. G.) 7 and P. G. 36 (Phthalocyanine Green); and the like. These colorants can be used alone or as a mixture of two or more kinds. The toner of the present invention may be any of black toners, monochromatic toners, and full color toners. The colorant is contained in an amount of preferably from 1 to 15 parts by weight, based on 100 parts by weight of a total amount of the vinyl resin and the polyester in the dispersion.

The releasing agent includes low-molecular weight polyolefins, such as polyethylenes, polypropylenes, and polybutenes; silicones; fatty acid amides, such as oleic acid amide, erucic acid amide, ricinoleic acid amide, and stearic acid amide; vegetable waxes, such as carnauba wax, rice wax, candelilla wax, wood wax, and jojoba oil; animal waxes, such as beeswax; mineral and petroleum waxes, such as montan wax, ozokerite, ceresin, paraffin wax, microcrystalline wax, and Fischer-Tropsch wax; and the like. These releasing agents may be used alone, or in a combination of two or more kinds.

The releasing agent has a melting point of preferably from 50° to 120° C., and more preferably a temperature equal to or lower than a softening point of a resin binder, taking into consideration the influences on blocking resistance and low-temperature fixing ability of the resin binder. The releasing agent is contained in an amount of preferably from 1 to 20 parts by weight, more preferably from 2 to 15 parts by weight, and even more preferably from 2 to 10 parts, based on 100 parts by weight of the resin binder, taking into consideration of the effects on low-temperature offset, influences on triboelectric chargeability, and the like.

As the charge control agent, any one of negatively chargeable and positively chargeable charge control agents can be used. The negatively chargeable charge control agent includes, for example, metal-containing azo dyes, copper phthalocyanine dyes, metal complexes of alkyl derivatives of salicylic acid, nitroimidazole derivatives, and the like. The positively chargeable charge control agent includes, for example, Nigrosine dyes, triphenylmethane-based dyes, quaternary ammonium salt compounds, polyamine resins, imidazole derivatives and the like. In addition, a polymeric charge control agent such as a resin can be used. The charge control agent is contained in an amount of preferably from 0.1 to 8 parts by weight, and more preferably from 0.2 to 5 parts by weight, based on 100 parts by weight of the resin binder.

The toner for electrophotography of the present invention may be a toner obtained by any of conventionally known methods such as a melt-kneading method, an emulsion phase-inversion method, and a polymerization method, and a pulverized toner produced by the melt-kneading method, including the step of melt-kneading a resin binder, specifically at least two kinds of polyester-based resins having different softening points, is preferable, from the viewpoint of productivity and dispersibility of a colorant. Incidentally, in the case of a pulverized toner produced by the melt-kneading method, specifically, the toner can be produced by mixing the above resin binder, and additives such as a colorant and a releasing agent with a mixer such as a Henschel mixer, thereafter melt-kneading the mixture with a closed kneader, a single-screw or twin-screw extruder, an open roller-type kneader, or the like, cooling, pulverizing, and classifying the product. The toner has a volume-median particle size ($D_{50}$) of preferably from 3 to 15 μm, and more preferably from 4 to 10 μm. The term "volume-median particle size ($D_{50}$)" as used herein means a particle size at 50% when calculated from particle sizes of smaller particle sizes in the cumulative volume frequency calculated in percentage on the volume basis.

Furthermore, the toner of the present invention may be subjected to an external addition treatment with an external additive such as fine inorganic particles of silica, alumina, titania, zirconia, tin oxide, zinc oxide, and the like, and fine organic particles such as fine resin particles.

As the external additive, silica having a small specific gravity is preferable, from the viewpoint of preventing embedment. The silica is preferably a hydrophobic silica subjected to a hydrophobic treatment, from the viewpoint of environmental stability. The method for hydrophobic treatment is not particularly limited, and an agent for the hydrophobic treatment includes hexamethyldisilazane (HMDS), dimethyldichlorosilane (DMDS), a silicone oil, methyl triethoxysilane, and the like. It is preferable that the processing amount of the agent for the hydrophobic treatment is from 1 to 7 mg/m$^2$ per surface area of the fine inorganic particles.

The external additive has a number-average particle size of preferably from 3 to 300 nm, and more preferably from 5 to 100 nm, from the viewpoint of triboelectric chargeability and prevention of a photosensitive member from being damaged.

The external additive is contained in an amount of preferably from 0.01 to 10 parts by weight, and more preferably from 0.1 to 5 parts by weight, based on 100 parts by weight of the toner matrix particles.

The toner of the present invention can be used as a toner for monocomponent development, or as a two component developer prepared by mixing the toner with a carrier.

In the present invention, the carrier is preferably a carrier having a low saturation magnetization, which forms a soft magnetic brush, from the viewpoint of the image properties. The saturation magnetization of the carrier is preferably from 40 to 100 $Am^2/kg$, and more preferably from 50 to 90 $Am^2/kg$. The saturation magnetization is preferably 100 $Am^2/kg$ or less from the viewpoint of controlling the hardness of the magnetic brush and retaining the tone reproducibility, and preferably 40 $Am^2/kg$ or more from the viewpoint of preventing the carrier adhesion and the toner scattering.

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; and glass beads; and the like. Among them, iron powder, magnetite, ferrite, copper-zinc-magnesium ferrite, manganese ferrite, and magnesium ferrite are preferable, from the viewpoint of triboelectric chargeability, and ferrite, copper-zinc-magnesium ferrite, manganese ferrite, and magnesium ferrite are more preferable, from the viewpoint of image quality.

It is preferable that the surface of the carrier is coated with a resin, from the viewpoint of reducing the contamination of the carrier. The resin for coating the surface of the carrier may vary depending upon the toner materials, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. These resins can be used alone or in admixture of two or more kinds. In the case where the toner is negatively chargeable, silicone resins are preferable, from the viewpoint of triboelectric chargeability and surface energy. The method of coating a core material with a resin is not particularly limited, and includes, for example, a method of dissolving or suspending a coating material such as a resin in a solvent, and applying the solution or suspension to be deposited on a core material, a method of simply blending in the state of powder, and the like.

In the two component developer of the present invention obtained by mixing a toner and a carrier, a weight ratio of the toner to the carrier, i.e. toner/carrier, is preferably from 1/99 to 10/90, and more preferably from 5/95 to 7/93.

EXAMPLES

The following examples further describe and demonstrate embodiments of the present invention. The examples are given solely for the purposes of illustration and are not to be construed as limitations of the present invention.

[Softening Point of Resins]

The softening point refers to a temperature at which a half of the sample flows out, when plotting a downward movement of a plunger of a flow tester (Shimadzu Corporation, "CFT-500D"), against temperature, in which a sample is prepared by applying a load of 1.96 MPa thereto with the plunger using the flow tester and extruding a 1 g sample through a nozzle having a die pore size of 1 mm and a length of 1 mm, while heating the sample so as to raise the temperature at a rate of 6° C./min.

[Softening Point of Rosins]

(1) Preparation of Samples

Ten grams of a rosin is melted on hot plate at 170° C. for 2 hours. Thereafter, the molten rosin is air-cooled in an environment of an open state at a temperature of 25° C. and relative humidity of 50% for 1 hour, and a cooled product is pulverized with a coffee mill (National Panasonic MK-61M) for 10 seconds.

(2) Measurement

The softening point refers to a temperature at which a half of the sample flows out, when plotting a downward movement of a plunger of a flow tester (Shimadzu Corporation, "CFT-500D"), against temperature, in which a sample is prepared by applying a load of 1.96 MPa thereto with the plunger using the flow tester and extruding a 1 g sample through a nozzle having a die pore size of 1 mm and a length of 1 mm, while heating the sample so as to raise the temperature at a rate of 6° C./min.

[Glass Transition Temperatures of Resins and Rosins]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter (Seiko Instruments, Inc., "DSC 210") of a sample of which temperature is raised at a rate of 10° C./min., the sample prepared by measuring out a sample in an amount of from 0.01 to 0.02 g on an aluminum pan, raising its temperature to 200° C., and cooling the sample from that temperature to 0° C. at a cooling rate of 10° C./min.

[Acid Values of Resins and Rosins]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio)).

[Hydroxyl Values of Resins]

The hydroxyl values are measured as prescribed by a method of JIS K0070.

[Amount of Low-Molecular Weight Component Contained Having Molecular Weight of 500 or Less]

The molecular weight distribution is measured by gel permeation chromatography (GPC). Ten milliliters of tetrahydrofuran is added to 30 mg of a toner, and the mixture is mixed with a ball-mill for 1 hour, and thereafter filtered with a fluororesin filter "FP-200" (manufactured by Sumitomo Electric Industries, Ltd.) having a pore size of 2 μm, to remove an insoluble component, to prepare a sample solution.

The measurement is taken by allowing tetrahydrofuran to flow through a column as an eluent at a flow rate of 1 ml per minute, stabilizing the column in a thermostat at 40° C., and loading 100 μl of a sample solution. Here, using "GMHLX+G3000HXL" (manufactured by Tosoh Corporation) as an analyzing column, a calibration curve of the molecular weights is drawn from several kinds of monodisperse polystyrenes (those having molecular weights of $2.63\times10^3$, $2.06\times10^4$, and $1.02\times10^5$ manufactured by Tosoh Corporation, and those having molecular weights of $2.10\times10^3$, $7.00\times10^3$, and $5.04\times10^4$ manufactured by GL Sciences Inc.) as standard samples.

The amount of the low-molecular weight component contained having a molecular weight of 500 or less (%) is calculated as a proportion of the area of the corresponding region in the area of the chart obtained by a RI (refractive index) detector, based on the entire area of the chart, i.e. the area of the corresponding region/the entire area of the chart.

[SP Values of Rosins]

A 2.1 g sample in a molten state is injected into a given ring, and the sample is then cooled to room temperature, and thereafter the SP values are measured under the following conditions as prescribed in JIS B7410.

Measuring apparatus: Automatic Ring and Ball Softening Point Tester ASP-MGK2 (manufactured by MEITECH Company Ltd.)

Heating rate: 5° C./min

Temperature at which heating is started: 40° C.

Measurement solvent: glycerol

[(Meth)acrylic Acid-Modified Degree of Rosins]

The (meth)acrylic acid-modified degree is calculated by the formula (Aa):

[Su 4]

$$\text{(Meth)acrylic Acid-Modified Degree} = \frac{Xa_1 - Y}{Xa_2 - Y} \times 100 \quad \text{(Aa)}$$

wherein $Xa_1$ is a SP value of a (meth)acrylic acid-modified rosin of which modified degree is calculated, $Xa_2$ is a saturated SP value of a (meth)acrylic acid-modified rosin obtainable by reacting one mol of (meth)acrylic acid and one mol of a rosin, and Y is a SP value of the rosin. The saturated SP value means a SP value when the reaction between (meth)acrylic acid and the rosin is carried out until the SP value of the resulting (meth)acrylic acid-modified rosin reaches a saturated value.

[Fumaric Acid-Modified Degree of Rosins]

The fumaric acid-modified degree is calculated by the formula (Af):

[Su 5]

$$\text{Fumaric Acid-Modified Degree} = \frac{Xf_1 - Y}{Xf_2 - Y} \times 100 \quad \text{(Af)}$$

wherein $Xf_1$ is a SP value of a fumaric acid-modified rosin of which modified degree is calculated, $Xf_2$ is a SP value of a fumaric acid-modified rosin obtainable by reacting one mol of fumaric acid and 0.7 mol of a rosin, and Y is a SP value of the rosin.

The SP value shown by $Xf_2$ is a SP value of a fumaric acid-modified rosin, obtained by raising the temperature of a mixture of 1 mol of fumaric acid, 0.7 mol of a rosin, and 0.4 g of t-butyl catechol from 160° to 200° C. over 2 hours, allowing the mixture to react at 200° C. for 2 hours, and thereafter distilling the reaction mixture at 200° C. under reduced pressure of 5.3 kPa.

[Maleic Acid-Modified Degree of Rosins]

The maleic acid-modified degree is calculated by the formula (Am):

[Su 6]

$$\text{Maleic Acid-Modified Degree} = \frac{Xm_1 - Y}{Xm_2 - Y} \times 100 \quad \text{(Am)}$$

wherein $Xm_1$ is a SP value of a maleic acid-modified rosin of which modified degree is calculated, $Xm_2$ is a saturated SP value of a maleic acid-modified rosin obtainable by reacting one mol of maleic acid and one mol of a rosin at 230° C., and Y is a SP value of the rosin.

The saturated SP value means a SP value when the reaction between maleic acid and the rosin is carried out until the SP value of the resulting maleic acid-modified rosin reaches a saturated value.

Here, in each of the formulas (Aa), the formula (Af), and the formula (Am), supposing that an acid value of a rosin is x (mgKOH/g), the molecular weight of 1 mol of the rosin can be calculated by the formula (B):

$$\text{Molecular Weight} = 56100 \div x \quad \text{(B)}$$

because x mg($x \times 10^{-3}$ g) of potassium hydroxide (molecular weight: 56.1) would be reacting to 1 g of the rosin.

[Melting Point of Releasing Agent]

A temperature of maximum endothermic peak of the heat of fusion obtained by raising the temperature of a sample at a rate of 10° C./min., the sample prepared by raising the temperature of a sample to 200° C. using a differential scanning calorimeter (Seiko Instruments, Inc., "DSC 210"), and cooling the heated sample from that temperature to 0° C. at a cooling rate of 10° C./min., is referred to as a melting point.

[Number-Average Particle Size of External Additive]

The number-average particle size is obtained by the following formula:

$$\text{Number-Average Particle Size (nm)} = 6/(\rho \times \text{Specific Surface Area } (m^2/g)) \times 1000$$

wherein ρ is a specific gravity of a fine inorganic powder or an external additive; and Specific Surface Area is a BET specific surface area obtained by nitrogen adsorption method of a raw powder, or a raw powder before the hydrophobic treatment in the case of an external additive. For example, the specific gravity of silica is 2.2, and the specific gravity of titanium oxide is 4.2.

Incidentally, the above formula is obtained from:

$$BET \text{ Specific Surface Area} = S \times (1/m)$$

wherein m(Mass of A Particle)=$\frac{4}{3} \times \pi \times (R/2)^3 \times$Density, and S (Surface Area)=$4a\ (R/2)^2$, supposing that a sphere has a particle size R.

[Volume-Median Particle Size ($D_{50}$) of Toner]

| | |
|---|---|
| Measuring Apparatus: | Coulter Multisizer II (manufactured by Beckman Coulter) |
| Aperture Diameter: | 100 μm |
| Analyzing Software: | Coulter Multisizer AccuComp Ver. 1.19 (manufactured by Beckman Coulter) |
| Electrolytic Solution: | "Isotone II" (manufactured by Beckman Coulter) |
| Dispersion: | "EMULGEN 109P" (manufactured by Kao Corporation, polyoxyethylene lauryl ether, HLB: 13.6) is dissolved in the above |

-continued

| [Volume-Median Particle Size ($D_{50}$) of Toner] | |
|---|---|
| | electrolytic solution so as to have a concentration of 5% by weight to give a dispersion. |
| Dispersion Conditions: | Ten milligrams of a measurement sample is added to 5 ml of the above dispersion, and the mixture is dispersed for 1 minute with a ultrasonic disperser, and 25 ml of an electrolytic solution is added to the dispersion, and further dispersed with a ultrasonic disperser for 1 minute, to prepare a sample dispersion. |
| Measurement Conditions: | The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution. |

B. GC (Gas Chromatography) (manufactured by Agilent, "HP6890")

Analyzing Column: DB-1 (60 m-320 μm-5 μm);

Carrier: Helium (He);

Flow Rate Conditions: 1 ml/min.;

Injection Inlet Temperature: 210° C.;

Column Head Pressure: 34.2 kPa;

Injection Mode: split;

Split Ratio: 10:1; and

Oven Temperature Conditions: 45° C. (3 min.)-10° C./min.-280° C. (15 min.).

C. MS (Mass Spectroscopy) (manufactured by Agilent, "HP5973")

Ionization Method EI (Electron Ionization) method;

Interface Temperature: 280° C.;

Ion Source Temperature: 230° C.;

Quadrupole Temperature: 150° C.; and

Detection Mode: Scan 29-350 m/s.

TABLE 1

| | Hexanoic Acid | Pentanoic Acid | Benzaldehyde | n-Hexanal | 2-Pentyl-furan | SP Value (° C.) Softening Point (° C.) | Acid Value (mg KOH/g) | Molecular weight per 1 mol |
|---|---|---|---|---|---|---|---|---|
| Unpurified Rosin | $0.9 \times 10^7$ | $0.6 \times 10^7$ | $0.6 \times 10^7$ | $1.8 \times 10^7$ | $1.1 \times 10^7$ | 77.0<br>74.3 | 169 | 332 |
| Purified Rosin | $0.4 \times 10^7$ | $0.2 \times 10^7$ | $0.2 \times 10^7$ | $1.4 \times 10^7$ | $0.7 \times 10^7$ | 76.8<br>75.1 | 166 | 338 |

<Purification Example of Rosin>

A 2000-ml distillation flask equipped with a fractionation tube, a reflux condenser and a receiver was charged with 1000 g of a tall rosin, and the tall rosin was distilled under a reduced pressure of 1 kPa, and a fractionation component at 195° to 250° C. was collected as a main fractionation component. Hereinafter, the tall rosin subjected to purification is referred to as "unpurified rosin," and a rosin collected as a main fractional component is referred to as "purified rosin."

Twenty grams of the rosin was pulverized with a coffee mill (National Panasonic MK-61M) for 5 seconds, and the rosin having sizes of 1-mm sieve opening-passed were measured off in an amount of 0.5 g in a vial for headspace (20 ml). A headspace gas was sampled, and the results of analyzing impurities in the unpurified rosin and the purified rosin by headspace GC-MS method are shown in Table 1.

[Measurement Conditions for Headspace GC-MS Method]

A. Headspace Sampler (manufactured by Agilent, "HP7694")

Sample Temperature: 200° C.;

Loop Temperature: 200° C.;

Transfer Line Temperature: 200° C.;

Equilibrating Time for Sample Heating: 30 min.;

Vial Pressure Gas: Helium (He);

Vial Pressing Time: 0.3 min.;

Loop Filling Time: 0.03 min.;

Loop Equilibrating Time: 0.3 min.; and

Injection Time: 1 min.

<Measurement of Saturated SP Value of Acrylic Acid-Modified Rosin Using Unpurified Rosin>

A 1000 ml flask equipped with a fractionating tube, a reflux condenser, and a receiver was charged with 332 g (1 mol) of an unpurified rosin (SP value: 77.0° C.) and 72 g (1 mol) of acrylic acid, and the temperature of the mixture was raised from 160° to 230° C. over a period of 8 hours. After having confirmed that the SP value did not increase at 230° C., the unreacted acrylic acid and low-boiling point substances were distilled away from the reaction mixture at a temperature of 230° C. under reduced pressure of 5.3 kPa, to give an acrylic acid-modified rosin. The resulting acrylic acid-modified rosin had a SP value, i.e., a saturated SP value of the acrylic acid-modified rosin using the unpurified rosin, of 110.1° C.

<Measurement of Saturated SP Value of Acrylic Acid-Modified Rosin Using Purified Rosin>

A 1000 ml flask equipped with a fractionating tube, a reflux condenser, and a receiver was charged with 338 g (1 mol) of a purified rosin (SP value: 76.8° C.) and 72 g (1 mol) of acrylic acid, and the temperature of the mixture was raised from 160° to 230° C. over a period of 8 hours. After having confirmed that the SP value did not increase at 230° C., the unreacted acrylic acid and low-boiling point substances were distilled away from the reaction mixture at a temperature of 230° C. under reduced pressure of 5.3 kPa, to give an acrylic acid-modified rosin. The resulting acrylic acid-modified rosin had a SP value, i.e., a saturated SP value of the acrylic acid-modified rosin using the purified rosin, of 110.4° C.

<Production Example 1 of Acrylic Acid-Modified Rosin>

A 10 L flask equipped with a fractionating tube, a reflux condenser, and a receiver was charged with 6084 g (18 mol) of a purified rosin (SP value: 76.8° C.) and 907.9 g (12.6 mol)

of acrylic acid, and the temperature of the mixture was raised from 160° to 220° C. over a period of 8 hours. The mixture was allowed to react at 220° C. for 2 hours, and the reaction mixture was then subjected to distillation at a temperature of 220° C. under reduced pressure of 5.3 kPa, to give an acrylic acid-modified rosin A. The acrylic acid-modified rosin A had a SP value of 110.4° C., a glass transition temperature of 57.1° C., and an acrylic acid-modified degree of 100.

<Production Example 2 of Acrylic Acid-Modified Rosin>

A 10 L flask equipped with a fractionating tube, a reflux condenser, and a receiver was charged with 6084 g (18 mol) of a purified rosin (SP value: 76.8° C.) and 648.5 g (9.0 mol) of acrylic acid, and the temperature of the mixture was raised from 160° to 220° C. over a period of 8 hours. The mixture was allowed to react at 220° C. for 2 hours, and the reaction mixture was then subjected to distillation at a temperature of 220° C. under reduced pressure of 5.3 kPa, to give an acrylic acid-modified rosin B. The acrylic acid-modified rosin B had a SP value of 99.1° C., a glass transition temperature of 53.2° C., and an acrylic acid-modified degree of 66.

<Production Example 3 of Acrylic Acid-Modified Rosin>

A 10 L flask equipped with a fractionating tube, a reflux condenser, and a receiver was charged with 5976 g (18 mol) of an unpurified rosin (SP value: 77.0° C.) and 907.6 g (12.6 mol) of acrylic acid, and the temperature of the mixture was raised from 160° to 220° C. over a period of 8 hours. The mixture was allowed to react at 250° C. for 2 hours, and the reaction mixture was then subjected to distillation at a temperature of 250° C. under reduced pressure of 5.3 kPa, to give an acrylic acid-modified rosin C. The acrylic acid-modified rosin C had a SP value of 110.1° C., a glass transition temperature of 54.5° C., and an acrylic acid-modified degree of 100.

<Measurement of SP Value of Fumaric Acid-Modified Rosin Using Unpurified Rosin, Usable as $Xf_2$ Value>

A 1000 ml flask equipped with a fractionating tube, a reflux condenser, and a receiver was charged with 332 g (1 mol) of an unpurified rosin (SP value: 77.0° C.), 81 g (0.7 mol) of fumaric acid, and 0.4 g of t-butyl catechol, the temperature of the mixture was raised from 160° to 200° C. over a period of 2 hours, and the mixture was allowed to react at 200° C. for 2 hours. Thereafter, the reaction mixture was subjected to distillation at a temperature of 200° C. under reduced pressure of 5.3 kPa to distill away the unreacted fumaric acid and low-boiling point substances from the reaction mixture, to give a fumaric acid-modified rosin. The resulting fumaric acid-modified rosin had a SP value, i.e., a SP value of the fumaric acid-modified rosin using the unpurified rosin, of 130.6° C.

<Measurement of SP Value of Fumaric Acid-Modified Rosin Using Purified Rosin, Usable as $Xf_2$ Value>

A 1000 ml flask equipped with a fractionating tube, a reflux condenser, and a receiver was charged with 338 g (1 mol) of a purified rosin (SP value: 76.8° C.), 81 g (0.7 mol) of fumaric acid, and 0.4 g of t-butyl catechol, the temperature of the mixture was raised from 160° to 200° C. over a period of 2 hours, and the mixture was allowed to react at 200° C. for 2 hours. Thereafter, the reaction mixture was subjected to distillation at a temperature of 200° C. under reduced pressure of 5.3 kPa to distill away the unreacted fumaric acid and low-boiling point substances from the reaction mixture, to give a fumaric acid-modified rosin. The resulting fumaric acid-modified rosin had a SP value, i.e. a SP value of the fumaric acid-modified rosin using the purified rosin, of 130.9° C.

<Production Example 1 of Fumaric Acid-Modified Rosin>

A 10 L flask equipped with a fractionating tube, a reflux condenser, and a receiver was charged with 5408 g (16 mol) of a purified rosin (SP value: 76.8° C.), 928 g (8 mol) of fumaric acid, and 0.4 g of t-butyl catechol, and the temperature of the mixture was raised from 160° to 200° C. over a period of 2 hours. The mixture was allowed to react at 200° C. for 2 hours, and the reaction mixture was then subjected to distillation at a temperature of 200° C. under reduced pressure of 5.3 kPa, to give a fumaric acid-modified rosin A. The fumaric acid-modified rosin A had a SP value of 130.8° C., a glass transition temperature of 74.4° C., and a fumaric acid-modified degree of 100.

<Production Example 2 of Fumaric Acid-Modified Rosin>

A 10 L flask equipped with a fractionating tube, a reflux condenser, and a receiver was charged with 5408 g (16 mol) of a purified rosin (SP value: 76.8° C.), 278 g (2.4 mol) of fumaric acid, and 0.4 g of t-butyl catechol, and the temperature of the mixture was raised from 160° to 200° C. over a period of 2 hours. The mixture was allowed to react at 200° C. for 2 hours, and the reaction mixture was then subjected to distillation at a temperature of 200° C. under reduced pressure of 5.3 kPa, to give a fumaric acid-modified rosin B. The fumaric acid-modified rosin B had a SP value of 98.4° C., a glass transition temperature of 48.3° C., and a fumaric acid-modified degree of 40.

<Production Example 3 of Fumaric Acid-Modified Rosin>

A 10 L flask equipped with a fractionating tube, a reflux condenser, and a receiver was charged with 5312 g (16 mol) of an unpurified rosin (SP value: 77.0° C.), 928 g (8 mol) of fumaric acid, and 0.4 g of t-butyl catechol, and the temperature of the mixture was raised from 160° to 200° C. over a period of 2 hours. The mixture was allowed to react at 200° C. for 2 hours, and the reaction mixture was then subjected to distillation at a temperature of 200° C. under reduced pressure of 5.3 kPa, to give a fumaric acid-modified rosin C. The fumaric acid-modified rosin C had a SP value of 130.4° C., a glass transition temperature of 72.1° C., and a fumaric acid-modified degree of 100.

<Measurement of Saturated SP Value of Maleic Acid-Modified Rosin Using Unpurified Rosin>

A 1000 ml flask equipped with a fractionating tube, a reflux condenser, and a receiver was charged with 332 g (1 mol) of an unpurified rosin (SP value: 77.0° C.) and 98 g (1 mol) of maleic anhydride, and the temperature of the mixture was raised from 160° to 230° C. over a period of 8 hours. After having confirmed that the SP value did not increase at 230° C., the unreacted maleic anhydride and low-boiling point substances were distilled away from the reaction mixture at a temperature of 230° C. under reduced pressure of 5.3 kPa, to give a maleic acid-modified rosin. The resulting maleic acid-modified rosin had a SP value, i.e., a saturated SP value of the maleic acid-modified rosin using the unpurified rosin, of 116° C.

<Measurement of Saturated SP Value of Maleic Acid-Modified Rosin Using Purified Rosin>

A 1000 ml flask equipped with a fractionating tube, a reflux condenser, and a receiver was charged with 338 g (1 mol) of a purified rosin (SP value: 76.8° C.) and 98 g (1 mol) of maleic anhydride, and the temperature of the mixture was raised from 160° to 230° C. over a period of 8 hours. After having confirmed that the SP value did not increase at 230° C., the unreacted maleic anhydride and low-boiling point substances were distilled away from the reaction mixture at a temperature of 230° C. under reduced pressure of 5.3 kPa, to give a maleic acid-modified rosin. The resulting maleic acid-modified rosin had a SP value, i.e., a saturated SP value of the maleic acid-modified rosin using the purified rosin, of 116° C.

<Production Example 1 of Maleic Acid-Modified Rosin>

A 10 L flask equipped with a fractionating tube, a reflux condenser, and a receiver was charged with 6084 g (18 mol)

of a purified rosin (SP value: 76.8° C.) and 1323 g (13.5 mol) of maleic anhydride, and the temperature of the mixture was raised from 160° to 220° C. over a period of 8 hours. The mixture was allowed to react at 220° C. for 2 hours, and the reaction mixture was then subjected to distillation at a temperature of 220° C. under reduced pressure of 5.3 kPa, to give a maleic acid-modified rosin A. The maleic acid-modified rosin A had a SP value of 116.2° C., a glass transition temperature of 57.6° C., and a maleic acid-modified degree of 101.

<Production Example 2 of Maleic Acid-Modified Rosin>

A 10 L flask equipped with a fractionating tube, a reflux condenser, and a receiver was charged with 6084 g (18 mol) of an unpurified rosin (SP value: 77.0° C.) and 529 g (5.4 mol) of maleic anhydride, and the temperature of the mixture was raised from 160° to 220° C. over a period of 8 hours. The mixture was allowed to react at 220° C. for 2 hours, and the reaction mixture was then subjected to distillation at a temperature of 220° C. under reduced pressure of 5.3 kPa, to give a maleic acid-modified rosin B. The maleic acid-modified rosin B had a SP value of 96.4° C. and a maleic acid-modified degree of 50.

<Resin Production Examples A1 to A6, and A8 to A12>

A 5-liter four-necked flask equipped with a fractionating tube through which a hot water at 98° C. was allowed to flow, the fractionating tube being equipped with a reflux condenser through which cold water at room temperature was allowed to flow at an upper part of the tube, a nitrogen inlet tube, a dehydration tube, a stirrer and a thermocouple was charged with an alcohol component, a carboxylic acid component other than trimellitic anhydride, and an esterification catalyst, as shown in Table 2 or 3, and the mixture was subjected to a polycondensation reaction at 160° C. for 2 hours under nitrogen atmosphere, the temperature was then raised to 210° C. over 6 hours, and thereafter the reaction mixture was allowed to react at 66 kPa for 1 hour. After cooling the mixture to a temperature of 200° C., the trimellitic anhydride as shown in Table 2 or 3 was introduced into the mixture, the mixture was then allowed to react thereat for 1 hour under normal pressure (101.3 kPa), the temperature was then raised to 210° C., and the reaction mixture was allowed to react at 40 kPa until a desired softening point was reached, to give each of the polyesters (resins A1 to A6, and A8 to A12).

<Resin Production Example A7>

A 5-liter four-necked flask equipped with a reflux condenser through which cold water at room temperature was allowed to flow, a nitrogen inlet tube, a dehydration tube, a dropping funnel, a stirrer and a thermocouple was charged with an alcohol component, a carboxylic acid component other than trimellitic anhydride, and an esterification catalyst, as shown in Table 3, and a mixture of styrene, 2-ethylhexyl acrylate, acrylic acid, and di-t-butyl peroxide as shown in Table 3, was added dropwise from the dropping funnel at 150° C. under nitrogen atmosphere over 2 hours, and thereafter the reaction mixture was subjected to an aging reaction for 2 hours at 150° C. Subsequently, the temperature was raised to 230° C., and the mixture was subjected to a polycondensation reaction thereat for 8 hours. After cooling the mixture to a temperature of 210° C., the trimellitic anhydride as shown in Table 3 was introduced into the mixture, the mixture was allowed to react thereat for 1 hour under normal pressure (101.3 kPa), the temperature was then raised to 210° C., and the reaction mixture was allowed to react at 40 kPa until a desired softening point was reached, to give a hybrid resin (resin A7) composed of a polyester unit and a vinyl resin unit.

TABLE 2

| | Resin A1 | Resin A2 | Resin A3 | Resin A4 | Resin A5 | Resin A6 |
|---|---|---|---|---|---|---|
| Alcohol Component | | | | | | |
| Ethylene Glycol | — | — | — | — | — | 124 g |
| 1,2-Propanediol | 920 g | 1125 g | 1233 g | 1074 g | 1107 g | 1221 g |
| 1,3-Propanediol | 80 g | — | 65 g | 66 g | — | 153 g |
| 2,3-Butanediol | — | 148 g | — | — | 154 g | — |
| BPA-PO[1)] | — | — | — | — | — | — |
| BPA-EO[2)] | — | — | — | — | — | — |
| Glycerol | 237 g | — | — | 190 g | 79 g | — |
| Carboxylic Acid Component | | | | | | |
| Terephthalic Acid | 1757 g | 1967 g | 2041 g | 2146 g | 2077 g | 2500 g |
| Trimellitic Anhydride | 580 g | 379 g | 394 g | 496 g | 494 g | 501 g |
| Fumaric Acid | — | — | — | — | — | — |
| Unpurified Rosin* | — | — | — | — | — | — |
| Acrylic Acid-Modified Rosin A | 925 g | 880 g | — | 527 g | — | — |
| Acrylic Acid-Modified Rosin B | — | — | 767 g | — | 590 g | — |
| Acrylic Acid-Modified Rosin C | — | — | — | — | — | — |
| Esterification Catalyst | | | | | | |
| Dibutyltin Oxide | — | — | — | — | — | — |
| Tin(II) Dioctanoate | 25 g | 25 g | 25 g | 25 g | — | 25 g |
| Titanium Diisopropylate Bis(Triethanolaminate) | — | — | — | — | 25 g | — |
| Amount (% by weight) of Rosin Contained in Carboxylic Acid | 28.4 | 27.3 | 24.0 | 16.6 | 18.7 | 0 |
| Physical Properties of Resin | | | | | | |
| Acid Value (mg KOH/g) | 35.5 | 40.1 | 35.4 | 28.8 | 33.4 | 29.5 |
| Hydroxyl Value (mg KOH/g) | 16.8 | 26.8 | 30.5 | 17.2 | 28.5 | 38.4 |
| Softening Point (° C.) | 146.9 | 106.2 | 99.8 | 134.0 | 116.8 | 150.1 |

TABLE 2-continued

| | Resin A1 | Resin A2 | Resin A3 | Resin A4 | Resin A5 | Resin A6 |
|---|---|---|---|---|---|---|
| Glass Transition Temperature (° C.) | 68.1 | 59.5 | 54.9 | 64.3 | 67.0 | 66.3 |
| Amount (%) of Low-Molecular Component Contained Having Molecular Weight of 500 or Less | 4.6 | 6.3 | 8.3 | 6.8 | 7.9 | 4.2 |

*Unmodified Rosin
1)Polyoxypropylene(2.2)-2,2-bis(4-hydroxyphenyl)propane
2)Polyoxyethylene(2.2)-2,2-bis(4-hydroxyphenyl)propane

TABLE 3

| | Resin A7 | Resin A8 | Resin A9 | Resin A10 | Resin A11 | Resin A12 |
|---|---|---|---|---|---|---|
| Alcohol Component | | | | | | |
| Ethylene Glycol | — | — | — | — | — | — |
| 1,2-Propanediol | — | — | 920 g | 1125 g | 881 g | 1064 g |
| 1,3-Propanediol | — | — | 80 g | — | 228 g | — |
| 2,3-Butanediol | — | — | — | 148 g | — | — |
| BPA-PO1) | 1698 g | 2174 g | — | — | — | — |
| BPA-EO2) | 676 g | 1153 g | — | — | — | — |
| Glycerol | — | — | 237 g | — | 169 g | — |
| Carboxylic Acid Component | | | | | | |
| Terephthalic Acid | 794 g | — | 1757 g | 1967 g | 2132 g | 1720 g |
| Trimellitic Anhydride | 106 g | 400 g | 580 g | 379 g | 399 g | 54 g |
| Fumaric Acid | — | 772 g | — | — | — | — |
| Unpurified Rosin* | — | — | — | — | 528 g | 1027 g |
| Acrylic Acid-Modified Rosin A | — | — | — | — | — | — |
| Acrylic Acid-Modified Rosin B | — | — | — | — | — | — |
| Acrylic Acid-Modified Rosin C | — | — | 925 g | 880 g | — | — |
| Raw Material Monomers for Vinyl Resin | | | | | | |
| Styrene | 1040 g | — | — | — | — | — |
| 2-Ethylhexyl Acrylate | 198 g | — | — | — | — | — |
| Acrylic Acid (Dually Reactive Monomer) | 40 g | — | — | — | — | — |
| Di-t-butyl Peroxide | 74 g | — | — | — | — | — |
| Esterification Catalyst | | | | | | |
| Dibutyltin Oxide | — | — | — | — | 20 g | 20 g |
| Tin(II) Dioctanoate | 20 g | — | 25 g | 25 g | — | — |
| Titanium Diisopropylate Bis(Triethanolaminate) | — | 10 g | — | — | — | — |
| Amount (% by weight) of Rosin Contained in Carboxylic Acid Component | 0 | 0 | 28.4 | 27.3 | 17.3 | 36.7 |
| Physical Properties of Resin | | | | | | |
| Acid Value (mg KOH/g) | 13.3 | 27.1 | 34.3 | 38.8 | 34.7 | 27.8 |
| Hydroxyl Value (mg KOH/g) | 41.5 | 37.5 | 15.3 | 26.2 | 18.3 | 20.3 |
| Softening Point (° C.) | 112.0 | 147.2 | 143.8 | 105.8 | 143.5 | 105.1 |
| Glass Transition Temperature (° C.) | 55.5 | 60.4 | 66.8 | 58.2 | 58.2 | 54.5 |
| Amount (%) of Low-Molecular Component Contained Having Molecular Weight of 500 or Less | 2.9 | 2.2 | 7.8 | 8.8 | 11.0 | 14.4 |

*Unmodified Rosin
1)Polyoxypropylene(2.2)-2,2-bis(4-hydroxyphenyl)propane
2)Polyoxyethylene(2.2)-2,2-bis(4-hydroxyphenyl)propane

Examples A1 to A7 and Comparative Examples A1 and A2

The resin binder as shown in Table 4, 4 parts by weight of a carbon black "MOGUL L" (manufactured by Cabot Corporation), 1 part by weight of a negatively chargeable control agent "BONTRON S-34" (manufactured by Orient Chemical Co., Ltd.), and 1 part by weight of a polypropylene wax "NP-105" (manufactured by MITSUI CHEMICALS, INC., melting point: 105° C.) were sufficiently mixed with a Henschel mixer, and thereafter the mixture was melt-kneaded with a unidirectional rotary twin-screw extruder at a roller rotational speed of 200 r/min and a heating temperature inside the roller of 80° C. The resulting melt-kneaded product was cooled and roughly pulverized, and thereafter pulverized with a jet mill, and a pulverized product was classified, to give a powder having a volume-median particle size ($D_{50}$) of 8.0 μm.

To 100 parts by weight of the resulting powder was added 1.0 part by weight of an external additive "Aerosil R-972" (manufactured by Nippon Aerosil Co., LTD., hydrophobic treatment agent: DMDS, number-average particle size: 16 nm), and the mixture was blended with a Henschel mixer, to give each of the toners.

Test Example A1

Low-Temperature Fixing Ability and Offset Resistance

A toner was loaded on a printer "OKI Microline 18" (manufactured by Oki Data Corporation, manufactured by CASIO COMPUTER CO., LTD., fixing: contact-fixing method, development method: nonmagnetic monocomponent development method), and an amount of toner adhesion was adjusted to 0.6 mg/cm$^2$, to give unfixed images. The obtained unfixed images were subjected to a fixing test by allowing unfixed images to fix while raising a temperature of the fixer roller from 100° to 240° C. with an increment of 5° C. using a fixing apparatus (fixing speed: 300 mm/s) modified so as to enable the obtained unfixed image to fix outside the machine with a fixing apparatus of a contact-fixing type copy machine "AR-505" (manufactured by Sharp Corporation).

"UNICEF Cellophane" tape (manufactured by MITSUBISHI PENCIL CO., LTD., width: 18 mm, JIS Z-1522) was adhered to the fixed images obtained at each fixing temperature, and the resulting fixed images were allowed to pass through the fixing roller of the above fixing apparatus set at 30° C., and the tape was then removed. The optical reflective densities before and after the removal of the tape were measured using a reflective densitometer "RD-915" (manufactured by Macbeth Process Measurements Co.). A temperature of the fixing roller at which the ratio of both of the optical reflective densities, i.e. that after removal/that before removal, initially exceeds 90% is defined as a lowest fixing temperature. The low-temperature fixing ability was evaluated in accordance with the following evaluation criteria. Also, the generation of hot offset was visually observed at the same time, and the offset resistance was evaluated in accordance with the following evaluation criteria. The results are shown in Table 4.

[Evaluation Criteria for Low-Temperature Fixing Ability]

◎ The lowest fixing temperature is lower than 150° C.,

○: The lowest fixing temperature is 150° C. or higher and lower than 170° C.

Δ: The lowest fixing temperature is 170° C. or higher and lower than 180° C.

X: The lowest fixing temperature is 180° C. or higher.

[Evaluation Criteria for Offset Resistance]

◎: The hot offset is not generated even at 240° C.,

○: The hot offset is generated at 220° C. or higher and 240° C. or lower.

Δ: The hot offset is generated at 190° C. or higher and lower than 220° C.

x: The hot offset is generated at a temperature of lower than 190° C.

Test Example A2

Durability

A toner was loaded to a printer "OKI Microline 18" (manufactured by Oki Data Corporation, manufactured by CASIO COMPUTER CO., LTD., fixing: contact-fixing method, development method: nonmagnetic monocomponent development method), and a durability printing test was conducted by continuously printing images of diagonally striped patterns having a blackening ratio of 10% under the conditions of 25° C. and a relative humidity of 60%. A solid image having a size of 3 cm×3 cm was printed at the initial printing (100 sheets) and post-durability printing (10,000 sheets), and the image density was determined. Here, the image density was defined as an average of the image densities of 5 sites, four corners and the center of the solid image. The durability was evaluated on the basis of the differences in the image densities at the initial printing and the post-durable printing, in accordance with the following evaluation criteria. The results are shown in Table 4.

Here, in the determination of the image density, "GRETAG SPM50" (manufactured by GretagMacbeth AG) was used. The white standard was calibrated with absolute white, the calibration using a calibration card "GretagMacbeth Density Calibration Reference" (Type: 47B/P, Density Standard: DIN 16536, Filter: Polarized).

(Evaluation Criteria)

The difference in the image densities between the initial printing and the post-durability printing is:

◎: less than 0.1;

○: 0.1 or more and less than 0.2;

Δ: 0.2 or more and less than 0.3; and x: 0.3 or more.

Test Example A3

Filming Resistance

A toner was loaded to a printer "PAGEPRESTO N-4" (manufactured by CASIO COMPUTER CO., LTD., fixing: contact-fixing method, development method: nonmagnetic monocomponent development method, developer roller diameter: 2.3 cm), and a filming test was conducted by continuously printing images of diagonally striped patterns having a blackening ratio of 5.5% under the conditions of 25° C. and a relative humidity of 60%. During the course of printing, black solid images were printed for every 500 sheets, and the presence or absence of the lines on the formed images was visually confirmed. At the point where the generation of the lines was confirmed, the printing was stopped. The filming test was conducted at the maximum of 10,000 sheets, and the durability was evaluated by defining the number of printed sheets at the point where the generation of lines was confirmed on the image as the number of durability printing sheets, in accordance with the following evaluation criteria. The results are shown in Table 4.

[Evaluation Criteria]

◎: No lines are generated up until 10,000 sheets, so that the number of durability printing sheets is 10,000 sheets or more.

○: The number of durability printing sheets is 5,000 sheets or more and less than 10,000 sheets.

Δ: The number of durability printing sheets is 2,000 sheets or more and less than 5,000 sheets.

x: The number of durability printing sheets is less than 2000 sheets.

Test Example A4

Storage Ability

Two sets of samples of 4 g of a toner each placed in an open-type cylindrical vessel having a diameter of 5 cm and a height of 2 cm were furnished, where one set of the samples was allowed to stand under the environmental conditions of a temperature of 40° C. and a relative humidity of 60%, and the other set of samples was allowed to stand under environmental conditions of a temperature of 55° C. and a relative humidity of 60%, each for 72 hours. After allowing the samples to stand, the vessels containing the toner were gently shaken, and the presence or absence of the generation of toner aggregation was visually observed. The storage ability was evaluated in accordance with the following evaluation criteria. The results are shown in Table 4.

[Evaluation Criteria]

◎: The toner aggregation is not found at all even under environmental conditions of both at 40° C. and 55° C.

○: Although the toner aggregation is not found under the environmental conditions of 40° C. at all, a slight amount of the lumps of toner aggregation is observed under the environmental conditions of 55° C.

Δ: Although the lumps of toner aggregation are found in a slight amount under the environmental conditions of 40° C., the toner aggregation is evidently found under the environmental conditions of 55° C.

x: The toner aggregation is evidently found under both of the environmental conditions of 40° C. and 55° C.

Test Example A5

Odor

Twenty grams of a toner was weighed in an aluminum foil cup (manufactured by Kabushiki Kaisha Teraoka; FM-409 (body)), and allowed to stand on a hot plate heated to 150° C. for 30 minutes. The odor generated from a toner was evaluated in accordance with the following evaluation criteria. The results are shown in Table 4.

[Evaluation Criteria]

◎: The odor is not sensed at all.

○: Hardly any odor is sensed.

Δ: Slight odor is sensed, but not posing any practical problems.

x: The odor is strongly sensed.

<Resin Production Examples B1 to B5, and B7 to B12>

A 5-liter four-necked flask equipped with a fractionating tube through which a hot water at 98° C. was allowed to flow, the fractionating tube being equipped with a reflux condenser through which cold water at room temperature was allowed to flow at an upper part of the tube, a nitrogen inlet tube, a dehydration tube, a stirrer and a thermocouple was charged with an alcohol component, a carboxylic acid component other than trimellitic anhydride, and an esterification catalyst, as shown in Table 5 or 6, and the mixture was subjected to a polycondensation reaction at 160° C. for 2 hours under nitrogen atmosphere, the temperature was then raised to 210° C. over 6 hours, and thereafter the reaction mixture was allowed to react at 66 kPa for 1 hour. After cooling the mixture to a temperature of 200° C., the trimellitic anhydride as shown in Table 5 or 6 was introduced into the mixture, the mixture was allowed to react thereat for 1 hour under normal pressure (101.3 kPa), the temperature was then raised to 210° C., and the reaction mixture was allowed to react at 40 kPa until a desired softening point was reached, to give each of the polyesters (resins B1 to B5 and B7 to B12).

<Resin Production Example B6>

A 5-liter four-necked flask equipped with a fractionating tube through which a hot water at 98° C. was allowed to flow, the fractionating tube being equipped with a reflux condenser through which cold water at room temperature was allowed to flow at an upper part of the tube, a nitrogen inlet tube, a dehydration tube, a stirrer and a thermocouple was charged with an alcohol component other than glycerol, a carboxylic acid component other than trimellitic anhydride, and an esterification catalyst, as shown in Table 5, and the mixture was subjected to a polycondensation reaction at 160° C. for 2 hours under nitrogen atmosphere, the temperature was then raised to 210° C. over 6 hours, and thereafter the reaction mixture was allowed to react at 66 kPa for 1 hour. After cooling the mixture to a temperature of 180° C., the glycerol as shown in Table 5 was introduced into the mixture, the temperature was raised to 200° C. at a rate of 5° C./30 minutes. Further, the mixture was allowed to react at 200° C. for 1 hour under normal pressure (101.3 kPa), and the mixture was then allowed to react at 66.0 kPa for 1 hour. Subsequently, the trimellitic anhydride as shown in Table 5 was introduced into the mixture, the reaction mixture was allowed to react for 1 hour under normal pressure (101.3 kPa), the temperature was then raised to 210° C., and the mixture was allowed to react at 40 kPa until a desired softening point was reached, to give a polyester (resin B6).

TABLE 4

| | Resin Binders | | | | | | | | | |
|---|---|---|---|---|---|---|---|---|---|---|
| | (A) | (B) | Others | Difference in Softening Points Between (A) and (B) (° C.) | Low-Temp. Fixing Ability | Offset Resistance | Durability | Filming Resistance | Storage Ability | Odor |
| Example A1 | Resin A2(50) | Resin A1(50) | — | 41 | ◎ | ◎ | ◎ | ◎ | ◎ | ◎ |
| Example A2 | Resin A3(50) | Resin A1(50) | — | 47 | ◎ | ◎ | ◎ | ◎ | ○ | ◎ |
| Example A3 | Resin A5(40) | Resin A4(60) | — | 17 | ○ | ○ | ◎ | ◎ | ◎ | ◎ |
| Example A4 | Resin A2(40) | Resin A6(60) | — | 44 | ◎ | ◎ | ○ | ○ | ◎ | ◎ |
| Example A5 | Resin A2(40) | Resin A8(60) | — | 41 | ○ | ○ | ◎ | Δ | ◎ | ◎ |
| Example A6 | Resin A2(40) | Resin A8(50) | Resin 7(10) | 41 | ○ | ○ | ◎ | ○ | ◎ | ◎ |
| Example A7 | Resin A10(40) | Resin A9(60) | — | 38 | ○ | ◎ | ◎ | ◎ | ○ | Δ |
| Comparative Example A1 | Resin A12(50) | Resin A11(50) | — | 38 | ◎ | Δ | Δ | ○ | X | X |
| Comparative Example A2 | | Resin A8(100) | | — | X | ○ | ◎ | ○ | ◎ | ◎ |

It can be seen from the above results that the toners of Examples A1 to A7 obtained by using a resin derived from a (meth)acrylic acid-modified rosin for at least one of the resin binders having different softening points have excellent low-temperature fixing ability and offset resistance even when subjected to fast printing, and maintain not only excellent durability and filming resistance but also excellent storage ability even under severe environmental conditions, as compared to the toner of Comparative Example A1 in which the resin using an unmodified rosin is used together and the toner of Comparative Example A2 containing a resin without using a modified rosin alone.

TABLE 5

| | Resin B1 | Resin B2 | Resin B3 | Resin B4 | Resin B5 | Resin B6 |
|---|---|---|---|---|---|---|
| Alcohol Component | | | | | | |
| Ethylene Glycol | — | — | — | — | — | — |
| 1,2-Propanediol | 933 g | 897 g | 1187 g | 883 g | 1192 g | 933 g |
| 1,3-Propanediol | 56 g | 224 g | — | 220 g | — | 56 g |
| 2,3-Butanediol | — | — | — | — | — | — |
| Glycerol | 231 g | 127 g | 72 g | 133 g | 72 g | 231 g |
| Carboxylic Acid Component | | | | | | |
| Terephthalic Acid | 1914 g | 1730 g | 2074 g | 1807 g | 2084 g | 1914 g |
| Trimellitic Anhydride | 369 g | 340 g | 274 g | 418 g | 274 g | 369 g |
| Unpurified Rosin* | — | — | — | — | — | — |
| Fumaric Acid-Modified Rosin A | 996 g | — | — | — | — | 996 g |
| Fumaric Acid-Modified Rosin B | — | — | — | 1037 g | — | — |
| Fumaric Acid-Modified Rosin C | — | — | — | — | — | — |
| Maleic Acid-Modified Rosin A | — | 1182 g | — | — | — | — |
| Maleic Acid-Modified Rosin B | — | — | — | — | — | — |
| Acrylic Acid-Modified Rosin A | — | — | 896 g | — | — | — |
| Acrylic Acid-Modified Rosin B | — | — | — | — | 880 g | — |
| Acrylic Acid-Modified Rosin C | — | — | — | — | — | — |
| Esterification Catalyst | | | | | | |
| Dibutyltin Oxide | — | — | — | — | 18 g | — |
| Tin(II) Dioctanoate | 25 g | 25 g | 25 g | 25 g | — | 25 g |
| Titanium Diisopropylate Bis(Triethanolaminate) | — | — | — | — | — | — |
| Amount (% by weight) of Rosin Contained in Carboxylic Acid Component | 30.4 | 36.3 | 27.6 | 31.8 | 27.2 | 30.4 |
| Physical Properties of Resin | | | | | | |
| Acid Value (mg KOH/g) | 28.8 | 25.5 | 35.8 | 23.6 | 33.6 | 32.5 |
| Hydroxyl Value (mg KOH/g) | 18.9 | 24.8 | 26.9 | 15.6 | 25.1 | 21.6 |
| Softening Point (° C.) | 148.6 | 140.9 | 103.5 | 135.8 | 106.6 | 128.6 |
| Glass Transition Temperature (° C.) | 68.5 | 64.2 | 58.8 | 62.2 | 56.8 | 64.3 |
| Amount (%) of Low-Molecular Component Contained Having Molecular Weight of 500 or Less | 4.3 | 6.3 | 7.4 | 9.3 | 10.2 | 7.6 |

*Unmodified Rosin

TABLE 6

| | Resin B7 | Resin B8 | Resin B9 | Resin B10 | Resin B11 | Resin B12 |
|---|---|---|---|---|---|---|
| Alcohol Component | | | | | | |
| Ethylene Glycol | — | — | 106 g | — | — | — |
| 1,2-Propanediol | 1107 g | 933 g | 1107 g | 1255 g | 881 g | 1064 g |
| 1,3-Propanediol | — | 56 g | — | — | 228 g | — |
| 2,3-Butanediol | 154 g | — | — | — | — | — |
| Glycerol | 79 g | 231 g | 80 g | — | 169 g | — |
| Carboxylic Acid Component | | | | | | |
| Terephthalic Acid | 2077 g | 1914 g | 2077 g | 2032 g | 2132 g | 1720 g |
| Trimellitic Anhydride | 494 g | 369 g | 494 g | 274 g | 399 g | 54 g |
| Unpurified Rosin* | — | — | — | — | 528 g | 1027 g |
| Fumaric Acid-Modified Rosin A | — | — | — | — | — | — |
| Fumaric Acid-Modified Rosin B | — | — | — | — | — | — |
| Fumaric Acid-Modified Rosin C | — | 996 g | — | — | — | — |
| Maleic Acid-Modified Rosin A | — | — | — | — | — | — |
| Maleic Acid-Modified Rosin B | — | — | — | 332 g | — | — |
| Acrylic Acid-Modified Rosin A | — | — | — | — | — | — |
| Acrylic Acid-Modified Rosin B | 590 g | — | — | — | — | — |
| Acrylic Acid-Modified Rosin C | — | — | 590 g | — | — | — |
| Esterification Catalyst | | | | | | |
| Dibutyltin Oxide | — | — | — | — | 20 g | 20 g |
| Tin(II) Dioctanoate | — | 25 g | 25 g | 25 g | — | — |
| Titanium Diisopropylate Bis(Triethanolaminate) | 25 g | — | — | — | — | — |
| Amount (% by weight) of Rosin Contained in Carboxylic Acid Component | 18.7 | 30.4 | 18.7 | 12.6 | 17.3 | 36.7 |

TABLE 6-continued

| | Resin B7 | Resin B8 | Resin B9 | Resin B10 | Resin B11 | Resin B12 |
|---|---|---|---|---|---|---|
| Physical Properties of Resin | | | | | | |
| Acid Value (mg KOH/g) | 33.4 | 27.6 | 40.2 | 32.9 | 34.7 | 27.8 |
| Hydroxyl Value (mg KOH/g) | 28.5 | 18.1 | 38.5 | 22.6 | 18.3 | 20.3 |
| Softening Point (° C.) | 116.8 | 144.3 | 110.2 | 129.3 | 143.5 | 105.1 |
| Glass Transition Temperature (° C.) | 67.0 | 66.5 | 60.5 | 73.0 | 58.2 | 54.5 |
| Amount (%) of Low-Molecular Component Contained Having Molecular Weight of 500 or Less | 7.9 | 5.6 | 7.9 | 4.6 | 11.0 | 14.4 |

*Unmodified Rosin

Examples B1 to B6 and Comparative Examples B1 and B2

Toners were prepared in the same manner as in Example A1 using 100 parts by weight of the resin binder shown in Table 7.

The low-temperature fixing ability, the offset resistance, the durability, the filming resistance, the storage ability, and the odor were evaluated in the same manner as in Test Examples A1 to A5, and the pulverizability was evaluated according to the following method. Here, the printer in Test Example A1 was changed to "PAGEPRESTO N-4" (manufactured by CASIO COMPUTER CO., LTD., fixing: contact-fixing method, development method: nonmagnetic mono-component development method, developer roller diameter: 2.3 cm). The results are shown in Table 7.

Test Example B1

Initial Rise of Triboelectric Charges

A 50 ml polyethylene bottle was charged with 0.6 g of a toner and 19.4 g of a silicone ferrite carrier (manufactured by Kanto Denka Kogyo, average particle size: 90 μm), and the components were mixed with a ball-mill at a rate of 250 r/min, and a triboelectric charge was determined using a q/m meter (manufactured by EPPING). A ratio of a triboelectric charge after a 15-second mixing time to the maximum triboelectric charge during a 600-second mixing time, i.e. triboelectric charge after 15-second mixing time/the maximum triboelectric charge during 600-second mixing time, was calculated, and the initial rise of triboelectric charges was evaluated in accordance with the following criteria. The results are shown in Table 7.

[Evaluation Criteria]

◎: The calculated ratio is 0.8 or more.

○: The calculated ratio is 0.6 or more and less than 0.8.

Δ: The calculated ratio is 0.4 or more and less than 0.6.

x: The calculated ratio is less than 0.4.

TABLE 7

| | Resin Binders (A) | Resin Binders (B) | Difference in Softening Points Between (A) and (B) (° C.) | Low-Temp. Fixing Ability | Offset Resistance | Durability | Filming Resistance | Initial Rise of Trigoelectric Charges | Storage Ability | Odor |
|---|---|---|---|---|---|---|---|---|---|---|
| Example B1 | Resin B3(50) | Resin B1(50) | 45 | ◎ | ◎ | ◎ | ◎ | ◎ | ◎ | ◎ |
| Example B2 | Resin B3(40) | Resin B2(60) | 37 | ◎ | ◎ | ◎ | ◎ | ◎ | ○ | ◎ |
| Example B3 | Resin B5(40) | Resin B4(60) | 29 | ◎ | ○ | ○ | ◎ | ◎ | ○ | ◎ |
| Example B4 | Resin B7(30) | Resin B6(70) | 12 | ○ | ○ | ◎ | ◎ | ◎ | ◎ | ◎ |
| Example B5 | Resin B9(40) | Resin B8(60) | 34 | ○ | ◎ | ◎ | ◎ | ◎ | ○ | Δ |
| Example B6 | Resin B3(50) | Resin B10(50) | 26 | ◎ | ○ | ○ | ○ | ◎ | Δ | Δ |
| Comparative Example B1 | Resin B12(50) | Resin B11(50) | 38 | ◎ | Δ | X | ○ | Δ | X | X |
| Comparative Example B2 | Resin B10(100) | | — | ○ | ○ | Δ | X | ○ | Δ | Δ |

Note)
The amounts of the resin binders are expressed by parts by weight.

It can be seen from the above results that the toners of Examples B1 to B6 in which a resin derived from a (meth) acrylic acid-modified rosin is used as a resin having a lower softening point, and a resin derived from a fumaric acid/maleic acid-modified rosin is used as a resin having a higher softening point have not only excellent low-temperature fixing ability, offset resistance, and durability even when subjected to fast printing, but also have excellent storage ability even under severe environmental conditions, as compared to that of Comparative Example B1 in which a resin using an unmodified rosin was used together, and Comparative Example B2 in which a resin derived from a maleic acid-modified rosin is used alone, and the toner further has excellent filming resistance and initial rise of triboelectric charges.

The toner for electrophotography of the present invention is usable in, for example, developing or the like latent images formed in electrophotography, electrostatic recording method, electrostatic printing method or the like.

The invention claimed is:

1. A toner for electrophotography, comprising a resin binder comprising a polyester-based resin (A) and a polyester-based resin (B) having a softening point of a temperature higher than the polyester-based resin (A) by 10° C. or more, wherein at least one of the polyester-based resins (A) and (B) is a resin derived from a (meth)acrylic acid-modified rosin, having a polyester unit prepared by polycondensing an alcohol component and a carboxylic acid component comprising a (meth)acrylic acid-modified rosin.

2. The toner for electrophotography according to claim 1, wherein the polyester-based resin (A) is the resin derived from a (meth)acrylic acid-modified rosin, having a polyester unit prepared by polycondensing an alcohol component and a carboxylic acid component comprising a (meth)acrylic acid-modified rosin, and the polyester-based resin (B) is a resin derived from a fumaric acid/maleic acid-modified rosin, having a polyester unit prepared by polycondensing an alcohol component and a carboxylic acid component comprising a fumaric acid-modified rosin and/or a maleic acid-modified rosin.

3. The toner for electrophotography according to claim 1, wherein the (meth)acrylic acid-modified rosin is contained in an amount of from 5 to 85% by weight of the carboxylic acid component of the resin derived from the (meth)acrylic acid-modified rosin.

4. The toner for electrophotography according to claim 2, wherein the fumaric acid-modified rosin and the maleic acid-modified rosin are contained in a total amount of from 5 to 85% by weight of the carboxylic acid component of the resin derived from the fumaric acid/maleic acid-modified rosin.

5. The toner for electrophotography according to claim 1, wherein the (meth)acrylic acid-modified rosin has a (meth) acrylic acid-modified degree of from 5 to 105.

6. The toner for electrophotography according to claim 2, wherein the fumaric acid-modified rosin has a fumaric acid-modified degree, and/or the maleic acid-modified rosin has a maleic acid-modified degree, of from 5 to 105.

7. The toner for electrophotography according to claim 1, wherein an alcohol component for the resin derived from the (meth)acrylic acid-modified rosin comprises a trihydric or higher polyhydric alcohol, and/or a carboxylic acid component for the resin comprises a tricarboxylic or higher polycarboxylic acid compound.

8. The toner for electrophotography according to claim 2, wherein an alcohol component for the resin derived from the fumaric acid/maleic acid-modified rosin comprises a trihydric or higher polyhydric alcohol, and/or a carboxylic acid component for the resin comprising a tricarboxylic or higher polycarboxylic acid compound.

9. The toner for electrophotography according to claim 1, wherein the polyester-based resin (A) has a softening point of from 80° to 120° C., and the polyester-based resin (B) has a softening point of from 100° to 180° C.

10. The toner for electrophotography according to claim 1, wherein an alcohol component for the resin derived from the (meth)acrylic acid-modified rosin comprises an aliphatic alcohol.

11. The toner for electrophotography according to claim 2, wherein an alcohol component for the resin derived from the fumaric acid/maleic acid-modified rosin comprises an aliphatic alcohol.

12. A method for producing a toner for electrophotography, comprising melt-kneading at least a polyester-based resin (A) and a polyester-based resin (B) having a softening point of a temperature higher than the polyester-based resin (A) by 10° C. or more, wherein at least one of the polyester-based resins (A) and (B) is a resin derived from a (meth)acrylic acid-modified rosin, having a polyester unit prepared by polycondensing an alcohol component and a carboxylic acid component comprising a (meth)acrylic acid-modified rosin.

13. The method according to claim 12, wherein the polyester-based resin (A) is the resin derived from a (meth)acrylic acid-modified rosin, having a polyester unit prepared by polycondensing an alcohol component and a carboxylic acid component comprising a (meth)acrylic acid-modified rosin, and the polyester-based resin (B) is a resin derived from a fumaric acid/maleic acid-modified rosin, having a polyester unit prepared by polycondensing an alcohol component and a carboxylic acid component comprising a fumaric acid-modified rosin and/or a maleic acid-modified rosin.

* * * * *